US007007710B2

(12) United States Patent
Heller et al.

(10) Patent No.: US 7,007,710 B2
(45) Date of Patent: Mar. 7, 2006

(54) MICROFLUIDIC DEVICES AND METHODS

(75) Inventors: Jonathan Heller, San Francisco, CA (US); John Stults, Redwood City, CA (US); Uthara Srinivasan, Palo Alto, CA (US); Luc Bousse, Los Altos, CA (US); Mingqi Zhao, Cupertino, CA (US)

(73) Assignee: Predicant Biosciences, Inc., South San Francisco, CA (US)

( * ) Notice: Subject to any disclaimer, the term of this patent is extended or adjusted under 35 U.S.C. 154(b) by 117 days.

(21) Appl. No.: 10/421,677

(22) Filed: Apr. 21, 2003

(65) Prior Publication Data

US 2004/0206399 A1 Oct. 21, 2004

(51) Int. Cl.
*B08B 7/00* (2006.01)
*F15B 21/00* (2006.01)

(52) U.S. Cl. ..... 137/15.01; 137/807; 137/827; 137/833; 251/368; 204/601; 422/100; 436/180

(58) Field of Classification Search ..... 137/827, 137/833, 807, 15.01; 204/601; 250/288; 422/100; 436/177, 180; 251/368
See application file for complete search history.

(56) References Cited

U.S. PATENT DOCUMENTS

| | | | | |
|---|---|---|---|---|
| 4,443,319 | A | 4/1984 | Chait et al. | |
| 4,483,885 | A | 11/1984 | Chait et al. | |
| 4,908,112 | A * | 3/1990 | Pace | 210/198.2 |
| 4,963,736 | A | 10/1990 | Douglas et al. | |
| 5,115,131 | A * | 5/1992 | Jorgenson et al. | 250/288 |
| 5,223,226 | A * | 6/1993 | Wittmer et al. | 422/100 |
| 5,296,114 | A | 3/1994 | Manz | |
| 5,306,910 | A * | 4/1994 | Jarrell et al. | 250/286 |
| RE034,757 | E | 10/1994 | Smith et al. | |
| 5,358,618 | A | 10/1994 | Ewing et al. | |
| 5,393,975 | A | 2/1995 | Hail et al. | |
| 5,423,964 | A | 6/1995 | Smith et al. | |
| 5,599,432 | A | 2/1997 | Manz et al. | |
| 5,624,539 | A | 4/1997 | Ewing et al. | |
| 5,705,813 | A | 1/1998 | Apffel et al. | |
| 5,716,825 | A | 2/1998 | Hancock et al. | |
| 5,788,166 | A * | 8/1998 | Valaskovic et al. | 239/708 |
| 5,800,690 | A | 9/1998 | Chow et al. | |
| 5,833,861 | A | 11/1998 | Afeyan et al. | |
| 5,856,671 | A | 1/1999 | Henion et al. | |
| 5,858,188 | A | 1/1999 | Soane et al. | |
| 5,858,195 | A | 1/1999 | Ramsey | |

(Continued)

FOREIGN PATENT DOCUMENTS

EP 0653631 B1 11/1994

(Continued)

OTHER PUBLICATIONS

Advanced Bioanalytical Services, Inc., Advanced bioanalytical services, inc. gains patent right to novel microfluidic handling system, <<http://www.advion.com/neulicensepress1.html. downloaded on May 9, 2002, 2 pages.

(Continued)

*Primary Examiner*—A. Michael Chambers
(74) *Attorney, Agent, or Firm*—Wilson Sonsini Goodrich & Rosati

(57) ABSTRACT

Microfluidic devices provide substances to a mass spectrometer. The microfluidic devices include first and second surfaces, at least one microchannel formed by the surfaces, and an outlet at an edge of the surfaces which is recessed back from an adjacent portion of the edge. Hydrophilic surfaces and/or hydrophobic surfaces guide substances out of the outlet. A source of electrical potential can help move substances through the microchannel, separate substances and/or provide electrospray ionization.

85 Claims, 7 Drawing Sheets

U.S. PATENT DOCUMENTS

| | | | | |
|---|---|---|---|---|
| 5,866,345 | A | 2/1999 | Wilding et al. | |
| 5,868,322 | A * | 2/1999 | Loucks et al. | 239/418 |
| 5,872,010 | A | 2/1999 | Karger et al. | |
| 5,885,470 | A | 3/1999 | Parce et al. | |
| 5,914,184 | A | 6/1999 | Morman | |
| 5,935,401 | A | 8/1999 | Amigo | |
| 5,945,678 | A * | 8/1999 | Yanagisawa | 250/423 F |
| 5,958,202 | A | 9/1999 | Regnier et al. | |
| 5,965,001 | A | 10/1999 | Chow et al. | |
| 5,969,353 | A | 10/1999 | Hsieh | |
| 5,993,633 | A * | 11/1999 | Smith et al. | 204/601 |
| 5,994,696 | A * | 11/1999 | Tai et al. | 250/288 |
| 6,001,229 | A | 12/1999 | Ramsey | |
| 6,010,607 | A | 1/2000 | Ramsey | |
| 6,010,608 | A | 1/2000 | Ramsey | |
| 6,012,902 | A | 1/2000 | Parce | |
| 6,033,546 | A | 3/2000 | Ramsey | |
| 6,033,628 | A | 3/2000 | Kaltenbach et al. | |
| 6,054,034 | A | 4/2000 | Soane et al. | |
| 6,056,860 | A | 5/2000 | Amigo et al. | |
| 6,068,749 | A | 5/2000 | Karger et al. | |
| 6,086,243 | A | 7/2000 | Paul et al. | |
| 6,110,343 | A | 8/2000 | Ramsey et al. | |
| 6,123,798 | A | 9/2000 | Gandhi et al. | |
| 6,136,212 | A * | 10/2000 | Mastrangelo et al. | 216/49 |
| 6,139,734 | A | 10/2000 | Settlage et al. | |
| 6,149,870 | A | 11/2000 | Parce et al. | |
| 6,156,181 | A | 12/2000 | Parce et al. | |
| 6,159,739 | A | 12/2000 | Weigl et al. | |
| 6,176,962 | B1 | 1/2001 | Soane et al. | |
| 6,187,190 | B1 | 2/2001 | Smith et al. | |
| 6,231,737 | B1 | 5/2001 | Ramsey et al. | |
| 6,238,538 | B1 | 5/2001 | Parce et al. | |
| 6,240,790 | B1 | 6/2001 | Swedberg et al. | |
| 6,245,227 | B1 | 6/2001 | Moon et al. | |
| 6,277,641 | B1 | 8/2001 | Yager | |
| 6,280,589 | B1 | 8/2001 | Manz et al. | |
| 6,284,113 | B1 | 9/2001 | Bjornson et al. | |
| 6,284,115 | B1 | 9/2001 | Apffel | |
| 6,318,970 | B1 | 11/2001 | Backhouse | |
| 6,322,682 | B1 | 11/2001 | Arvidsson et al. | |
| 6,337,740 | B1 | 1/2002 | Parce | |
| 6,342,142 | B1 | 1/2002 | Ramsey | |
| 6,368,562 | B1 | 4/2002 | Yao | |
| 6,375,817 | B1 | 4/2002 | Taylor et al. | |
| 6,394,942 | B1 | 5/2002 | Moon et al. | |
| 6,409,900 | B1 | 6/2002 | Parce et al. | |
| 6,413,401 | B1 | 7/2002 | Chow et al. | |
| 6,416,642 | B1 | 7/2002 | Alajoki et al. | |
| 6,417,510 | B1 | 7/2002 | Moon et al. | |
| 6,423,198 | B1 | 7/2002 | Manz et al. | |
| 6,432,311 | B1 | 8/2002 | Moon et al. | |
| 6,444,461 | B1 | 9/2002 | Knapp et al. | |
| 6,450,047 | B1 | 9/2002 | Swedberg et al. | |
| 6,450,189 | B1 | 9/2002 | Ganan-Calvo | |
| 6,454,924 | B1 | 9/2002 | Jedrzejewski et al. | |
| 6,454,938 | B1 | 9/2002 | Moon et al. | |
| 6,459,080 | B1 | 10/2002 | Yin et al. | |
| 6,461,516 | B1 | 10/2002 | Moon et al. | |
| 6,462,337 | B1 | 10/2002 | Li et al. | |
| 6,464,866 | B1 | 10/2002 | Moon et al. | |
| 6,465,776 | B1 * | 10/2002 | Moini et al. | 250/285 |
| 6,475,363 | B1 | 11/2002 | Ramsey | |
| 6,475,441 | B1 | 11/2002 | Parce et al. | |
| 6,481,648 | B1 * | 11/2002 | Zimmermann | 239/690 |
| 6,491,804 | B1 | 12/2002 | Manz et al. | |
| 6,495,016 | B1 | 12/2002 | Nawracala | |
| 6,500,323 | B1 | 12/2002 | Chow et al. | |
| 6,514,399 | B1 | 2/2003 | Parce et al. | |
| 6,517,234 | B1 | 2/2003 | Kopf-Sill et al. | |
| 6,524,456 | B1 | 2/2003 | Ramsey et al. | |
| 6,541,768 | B1 | 4/2003 | Andrien, Jr. et al. | |
| 6,555,067 | B1 | 4/2003 | Gandhi et al. | |
| 6,569,324 | B1 | 5/2003 | Moon et al. | |
| 6,576,896 | B1 | 6/2003 | Figeys et al. | |
| 6,596,988 | B1 | 7/2003 | Corso et al. | |
| 6,602,472 | B1 | 8/2003 | Zimmermann et al. | |
| 6,605,472 | B1 | 8/2003 | Skinner et al. | |
| 6,607,644 | B1 | 8/2003 | Apffel, Jr. | |
| 6,621,076 | B1 | 9/2003 | van de Goor et al. | |
| 6,627,076 | B1 | 9/2003 | Griffiths | |
| 6,627,882 | B1 | 9/2003 | Schultz et al. | |
| 6,632,655 | B1 | 10/2003 | Mehta et al. | |
| 6,653,625 | B1 | 11/2003 | Andersson et al. | |
| 6,670,607 | B1 * | 12/2003 | Wood et al. | 250/288 |
| 6,681,788 | B1 | 1/2004 | Parce et al. | |
| 6,695,009 | B1 | 2/2004 | Chien et al. | |
| 6,709,559 | B1 | 3/2004 | Sundberg et al. | |
| 6,733,645 | B1 | 5/2004 | Chow | |
| 6,744,046 | B1 | 6/2004 | Valaskovic et al. | |
| 6,803,568 | B1 | 10/2004 | Bousse et al. | |
| 6,814,859 | B1 | 11/2004 | Koehler et al. | |
| 6,827,095 | B1 | 12/2004 | O'Connor et al. | |
| 2001/0037979 | A1 | 11/2001 | Moon et al. | |
| 2001/0041357 | A1 | 11/2001 | Fouillet et al. | |
| 2002/0036140 | A1 | 3/2002 | Manz et al. | |
| 2002/0041827 | A1 | 4/2002 | Yager et al. | |
| 2002/0079219 | A1 | 6/2002 | Zhao et al. | |
| 2002/0100714 | A1 | 8/2002 | Staats | |
| 2002/0110902 | A1 | 8/2002 | Prosser et al. | |
| 2002/0117517 | A1 | 8/2002 | Unger et al. | |
| 2002/0121487 | A1 | 9/2002 | Robotti et al. | |
| 2002/0122474 | A1 | 9/2002 | Zhao et al. | |
| 2002/0123153 | A1 | 9/2002 | Moon et al. | |
| 2002/0139931 | A1 | 10/2002 | Yin et al. | |
| 2002/0158195 | A1 | 10/2002 | Andersson et al. | |
| 2002/0170825 | A1 | 11/2002 | Lee et al. | |
| 2002/0182649 | A1 | 12/2002 | Weinberger et al. | |
| 2003/0000835 | A1 | 1/2003 | Witt et al. | |
| 2003/0013203 | A1 | 1/2003 | Jedrzejewski et al. | |
| 2003/0017609 | A1 | 1/2003 | Yin et al. | |
| 2003/0026740 | A1 | 2/2003 | Staats | |
| 2003/0029724 | A1 | 2/2003 | Derand et al. | |
| 2003/0047680 | A1 | 3/2003 | Figeys et al. | |
| 2003/0066959 | A1 | 4/2003 | Andersson et al. | |
| 2003/0073260 | A1 | 4/2003 | Corso | |
| 2003/0082080 | A1 | 5/2003 | Hans-Peter et al. | |
| 2003/0089605 | A1 | 5/2003 | Timperman | |
| 2003/0089606 | A1 | 5/2003 | Wallace et al. | |
| 2003/0106799 | A1 | 6/2003 | Covington et al. | |
| 2003/0111599 | A1 | 6/2003 | Staats | |
| 2003/0141392 | A1 | 7/2003 | Nilsson et al. | |
| 2003/0146757 | A1 | 8/2003 | Aguero et al. | |
| 2003/0148922 | A1 | 8/2003 | Knapp et al. | |
| 2003/0153007 | A1 | 8/2003 | Chen et al. | |
| 2003/0180965 | A1 | 9/2003 | Yobas et al. | |
| 2003/0213918 | A1 | 11/2003 | Kameoka et al. | |
| 2003/0215855 | A1 | 11/2003 | Dubrow et al. | |
| 2003/0224531 | A1 | 12/2003 | Brennen et al. | |
| 2005/0000569 | A1 | 1/2004 | Bousse | |
| 2004/0053333 | A1 | 3/2004 | Hitt | |
| 2004/0075050 | A1 | 4/2004 | Rossier et al. | |
| 2004/0084402 | A1 | 5/2004 | Ashmead et al. | |
| 2004/0096960 | A1 | 5/2004 | Burd Mehta et al. | |
| 2004/0113068 | A1 | 6/2004 | Bousse | |
| 2004/0159783 | A1 | 8/2004 | Gavin et al. | |
| 2004/0229377 | A1 | 11/2004 | Chen et al. | |
| 2005/0047969 | A1 | 3/2005 | Bousse | |
| 2005/0072915 | A1 | 4/2005 | Stults | |
| 2005/0123688 | A1 | 6/2005 | Craighead et al. | |

FOREIGN PATENT DOCUMENTS

| | | | |
|---|---|---|---|
| GB | 2379554 | A | 3/2003 |
| WO | WO 91/011015 | | 7/1991 |
| WO | WO 96/004547 | | 2/1996 |
| WO | WO 96/036425 | | 11/1996 |
| WO | WO 00/30167 | | 5/2000 |
| WO | WO 00/041214 | | 7/2000 |
| WO | WO 00/062039 | | 10/2000 |
| WO | WO 01/26812 | | 4/2001 |
| WO | WO 01/57263 | A1 | 8/2001 |
| WO | WO 01/94907 | A2 | 12/2001 |
| WO | WO 02/030486 | A2 | 4/2002 |
| WO | WO 02/030486 | A3 | 4/2002 |
| WO | WO 02/045865 | A1 | 6/2002 |
| WO | WO 02/047913 | A1 | 6/2002 |
| WO | WO 02/055990 | A3 | 7/2002 |
| WO | WO 02/080222 | A1 | 10/2002 |
| WO | WO 03/004160 | | 1/2003 |
| WO | WO 03/019172 | | 3/2003 |
| WO | WO 03/054488 | A1 | 7/2003 |
| WO | WO 2004/044574 | A1 | 5/2004 |
| WO | WO 04/51697 | | 6/2004 |
| WO | WO 2004/062801 | A1 | 7/2004 |
| WO | WO 2004/067162 | A2 | 8/2004 |
| WO | WO 2004/070051 | A2 | 8/2004 |
| WO | WO 2004/075241 | | 9/2004 |

OTHER PUBLICATIONS

Advion Biosciences, Automated Nanospray, <<http://www.advion.com/advion_auxfiles/AutomatedNanospary/sld001.htm>>, downloaded on May 9, 2002, 13 pages.

Advion Biosciences, Coming soon . . . the advion nanomate™ 100, <<http://www.advion.com/>>, downloaded on May 9, 2002, 6 pages.

APPLERA Corp., Applied biosystems, northeastern UN and professors Barry L. Karger, Ph.D collaboration to research advance separation technology for protection, <<http://www.applera.com/press/prccorp111901a.html>>, downloaded on May 9, 2002, 3 pages.

Becker, Polymer microfluidic devices, Talanta, vol. 56, 2002, 267-287.

Chen et al., A disposable poly(methylmethacrylate)-based microfluidic module for protein identification by nanoelectrospary ionization-tandem mass spectrometry, Electrophoresis, 2001, vol. 22, 3972-3977.

Chiou et al., Micro devices integrated with microchannels and electrospray nozzles using PDMS casting techniques, Sensors and Actuators, 2002, B 4311, 1-7.

CRISP, Computer retrieval of information on scientific projects [abstract]; <<http://commons.cit.nih.gov/crisp3/CRISP_LIB.getdoc?textkey=6388327&p_grant_num=5RO1HG002033-03&p_query=&ticket=. . . >>, downloaded on May 9, 2002, 2 pages.

DIAGNOSWISS, Disposable nano-electrospays, <<http://www.diagnoswiss.com/products/disp_nano_electr.html<<, downloaded on May 9, 2002, 2 pages.

Figeys et al., A microfabricated device for rapid protein identification by microelectrospray ion trap mass spectrometry, Anal Chem, 1997, vol. 69, 3153-3160.

Gobry et al., Microfabricated polymer injector for direct mass spectrometry coupling, Proteomics 2002, 2, 405-412.

Kameoka et al., A polymeric microfluidic chip for CE/MS determination of small molecules, Anal. Chem., 2001, vol. 73, 1935-1941.

Kameoka et al., An electrospray Ionization source for integration with Microfluidics, Anal. Chem., Nov. 15, 2002, 74:22, 5897-5901.

Kim et al., Microfabricated PDMS multichannel emitter for electrospray ionization mass spectrometry, J. Am. Soc. Mass. Spectrom, 2001, vol. 12, 463-469.

Kim et al., Microfabrication of polydemethylsiloxane electrospary ionization emitters, J. Chromatogr. A., 2001, 924, 137-145.

Kim et al., Miniaturized multichannel electrospary Ionization emitters on poly(dimethylsiloxane) microfluidic devices, Electrophoresis, 2001, vol. 22, 3993-3999.

Li et al., Rapid and sensitive separation of trace level protein digests using microfabricated devices coupled to a quadrupole—time-of-flight mass spectrometer, Electrophoresis, 2000, vol. 21, 198-210.

Li et al., Separation and identification of peptides from gel-isolated membrane proteins using a electrophoresis/nanoelectrospary and spectrometry, Analytical Chemistry, Feb. 1, 2000, 72:3 599-609.

Oleschuk et al., Analytical microdevices for mass spectrometry, Trends in Analytical Chemistry, 2000, 19:6, 379-388.

Premestaller et al., High-performance liquid chromatography-electrospray Ionization mass spectrometry using monolithic capillary columns for proteomic studeies, Anal. Chem., 2000, vol. 73, 2390-2396.

Rohner et al., Polymer microspary with an integrated thick-film microelectrode, Anal. Chem., 2001, vol.73, 5353-5357.

Schultz et al., A fully integrated monolithic microchip electrospray device for mass spectrometry, Anal. Chem., 2000, vol. 72, 4058-4063.

Srinivasan, ESI and/or CE on microfluidic chips: literature review, Sep. 18, 2002, 14 pages.

Tang et al., Generation of multiple electrospary using microfabricated emitter arrays for improved mass spectromrtric sensitivity, Anal. Chem., 2001, vol. 73, 1658-1663.

Bings, Nicolas H., "Microfluidic devices connected to fuse-silica capillaries with minimal dead volume". *Anal. CHem.* (1999), 71:3292-3296.

Cao, Ping et al., "Analysis of peptides, proteins, protein digests, and whole human blood by capillary electrophoresis/electrospary ionization-mass spectrometry using an in-capillary electrode sheathless interface". *J. Am. Mass Spectrometry* (1998), 9:1081-1088.

Chan, Jason H., "Microfabricated polymer devices for automated sample delivery of peptides for analysis by electrospray ionization tandem mass spectrometry". *Anal. Chem.* (1999), 71:4437-4444.

Deng, Yuzhong, et al., "Chip-based quanititative capillary electrophoresis/mass spectrometry determination of drugs in human plasma". *Analytical Chemistry* (Apr. 1, 2001), 73(7) 1432-1439.

Figeys, Daniel, et al., "Nanoflow solvent gradient delivery from a microfabricated device for protein identification by electroscopy Ionization mass spectrometry". *Anal. Chem.* (1998) 70:3721-3727.

Geromanos, S., et al., "InJection adaptable Fine Ionization Source ('JaFIS') for Continuous Flow Nano-electrospray", *Rapid Commun. Mass Spectrom* (1998) 12:551-556.

Geromanos, S., et al., "Tuning of an electrospary ionization source for maximum peptide-ion transmission into a mass spectrometer". *Anal. CHem.* (2000) 72(4)777-790.

Hayes, Roger N., et al., "Collision-induced Dissociation". *Methods in Enzymology* (1990), 193:237-263.
Issaq, Haleem J., et al., "SELDI-TOF MS for diagnostic proteomics". *Analytical Chemistry* (Apr. 1, 2003) 149-155.
Jiang, Yun et al., "Integrated plastic microfluidic devices with ESI-MS for drug screening and residue analysis". *Anal. CHem.* (2001) 73:2048-2053.
Koutny, Lance B., et al., "Microchip electrophoretic immunoassay for serum cortisol". *Anal. Chem.* (1996) 68:18-22.
Lazar, Iulia M., "Subattomole-sensitivity microchip nanelectropray source with time-of-flight mass spectrometry detection". *Anal. Chem.* (1999) 71:3627-3631.
Li, Jianjun, et al., "Application of microfluidic devices to proteomics research". *Molecular & Cellular Proteomics* (2002) 157-168.
Lin, Yuehe, et al., "Microfluidic devices on polymer substrates for bioanalytical applications". *Pacific Northwest National Laboratory* (1999), Richland, WA, USA, 10 pages.
Liu, Hanghui, et al., "Development of multichannel devices with an array of electrospray tips for high-throughput mass spectrometry". *Anal. Chem.* (2000) 72:3303-3310.
Neuhoff, Nils V., et al., "Mass spectrometry for the detection of differentially expressed proteins: a comparison of surface-enhanced laser desorption/ionization and capillary electrophoresis/mass spectrometry", *Rapid Comm. In Mass Spectrometry* (2004), 18:149-156.
Ramsey, R.S., et al. "Generating electrospray from microchip devices using electroosmotic pumping". *Analytical Chemistry* (Mar. 15, 1997) , 69(6)1174-1178.
Rocklin, Roy D. et al., "A microfabricated fluidic device for performing two-dimensional liquid-phase separations". *Anal. Chem.* (2000) 72:5244-5249.
Schmitt-Kopplin, Phillippe, et al., "Capillary electrophoresis—mass spectrometery: 15 years of developments and applications". *Electrophoresis* (2003), 3837-3867.
Selby, David S., et al., "Direct quantification of alkaloid mixtures by electrospray ionization mass spectrometry". *Journal of Mass Spectrometry* (1998) 33:1232-1236.
Svedberg, Malin, et al., "Sheathless electrospray from polymer microchips". *Anal. Chem.* (2003) 75:3934-3940.
Tang, Ning, et al., "Current developments in SELDI affinity technology". *Mass Spectrometry Reviews* (2004), 23:34-44.
Tomilson, Andy J., et al., "Investigation of drug metabolism using capillary electrophoresis with photodiode array detection and on-line mass spectrometry equipped with an array detector". *Electrophoresis* (1994), 13:62-71.
Tomilson, Andy J., et al., "Utility of Membrane Preconcentration—Capillary Electrophoresis—Mass Spectrometry in Overcoming Limited Sample Loading for Analysis of Biotogically Derived Drug Metabolites, Peptides, and Proteins". *J Am Soc Mass Spectrom* (1997), 8:15-24.
Wachs, Timothy, et al., "Electrospray device for coupling microscale separations and other miniaturized devices with electrospray mass spectrometry", *Anal. Chem.* (2001) 73: 632-638.
Wang, Michael Z., et al., "Analysis of human serum proteins by liquid phase isoelectric focusing and matrix-assisted laser desorption/ionization-mass spectrometry". *Proteomics* (2003), 3:1661-1666.
Wen, Jenny, et al, "Microfabricated isoelectric focusing device for direct electrospray ionization-mass spectrometry". *Electrophoresis* (2000) 21:191-197.
Wright, G.L. et al., "Proteinchip surface enhanced laser desorption/ionization (SELDI) mass spectrometry: a novel protein biochip technology for detection of prostate cancer biomarkers in complex protein mixtures". *Prostate Cancer and Prostatic Disease* (1999) 2:264-276.
Xue, Qifeng, et al., "Multichannel microchip electrospray mass spectrometry". *Analytical Chemistry* (Feb. 1, 1997), 69(3)426-430.
Zhang, et al., "A microdevice with integrated liquid junction for facile peptide and protein analysis by capillary electrophoresis/electrospray mass spectrometry". *Anal. Chem.* (2000) 72:1015-1022.
Zhang, et al., "Microfabricated devices for capillary electrophoresis-electrospray mass spectrometry". *Anal. Chem.* (Aug. 1, 1999), 71(5)3258-3264.
Auriola, Seppo et al., "Enhancement of sample loadings for the analysis of oligosaccharides isolated from *Pseudomonas aeruginosa* using transient isotachophoresis—electrospray—mass spectrometry", *Electrophoresis* (1988), 19:2665-2676.
Balaguer, E. et al., "Comparison of sheathless and sheathless and sheath flow electrospray interfaces for an online capillary electrophoresis mass spectrometry of therapeutic peptide hormones". *Diagnoal* 647, 08028, (2004), Salzberg, Austria.
Banks, Jr., J. Fred et al., "Detection of last capillary electrophoresis peptide and protein separations using electrospray ionization with a time-of-flight mass spectrometer". *Anal. Chem.* (May 1, 1996), 68(9):1480-1485.
Banks, J. Fred, "Recent advances in capillary electrophoresis/electrospray/mass spectrometry". *Electrophoresis* (1997), 18:2255-2266.
Chang, Yan Zin et al., "Sheathless capillary electrophoresis/electrospray mass spectrometry using a carbon-coated fused-silica capillary". *Anal. CHem.* (Feb. 1, 2000), 72(3): 626-630.
Chen, Yet-Ran et al., "A low-flow CE/electrospray ionization MS interface for capillary zone electrophoresis, large-volume sample stacking, and micellar electrokinetic chromatography". *Anal. Chem.* (Feb. 1, 2003), 75(3):503-508.
Chien, Ring-Ling et al., "Sample stacking of an extremely large injection volume in high-performance capillary electrophoresis". *Anal. Chem.* (1992), 64:1046-1050.
Ding, Jinmel et al., "Advances in CE/MS: recent developments in interfaces and applications". *Analytical Chemistry News & Features* (Jun. 1, 1999), 378A-385A.
Figeys, Daniel et al., "High sensitivity analysis of proteins and peptides by capillary electrophoresis-tandem mass spectrometry: recent developments in technology and applications". *Electrophoresis*, (1998), 19:885-892.
Figeys, Daniel et al., "Protein identification by solid phase microextraction-capillary zone electrophoresis-microelectrospray-tandem mass spectrometry". *Nature Biotechnology* (Nov. 1996), 14:1579-1583.
Foret, Frantisek et al., "Trace analysis of proteins by capillary zone electrophoresis with on-column transient isotachophoretic preconcentration". *Electrophoresis* (1993), 14:417-428.
Guo, Xu et al., "Analysis of metallonthioeins by means of capillary electrophoresis coupled to electrospray mass spectrometry with sheathless interfacing" *Rapid Commun. Mass Spectrom.* (1999), 13:500-507.
Janini, George M. et al., "A Sheathless nanoflow electrospray interface for on-line capillary electrophoresis mass spectrometry". *Anal. Chem.* (2003), 75:1615-1619.
Johansson, I. Monika et al., "Capillary electrophoresis-atmospheric pressure ionization mass spectrometry for the characterization of peptides". *Journal of chromatography* (1991), 554:311-327.
Kasier, Thorsten et al., "Capillary electrophoresis coupled to mass spectrometer for automated and robust polypeptide determination in body fluids for clinical use". *Electrophoresis* (2004), 25:2044-2055.
Kaiser, Thorsten et al., "Capillary electrophoresis coupled to mass spectrometry to establish polypeptide patterns in dialysis". *Journal of Chromatography A* (2003) 1013:157-171.
Kelly, John F. et al., "Capillary zone electrophoresis-electrospray mass spectrometry in submicroliter flow rates: practical considerations and analytical performance". *Anal. Chem.* )1997), 69:51-60.
Kirby, Daniel P. et al., "A CE/ESI-MS interface for stable, low-flow operation". *Anal. Chem.* (1996), 68:4451-4457.
Larsson, Marita et al., "Transient isotachophoresis for sensitivity enhancement in capillary electrophoresis-mass spectrometry for people analysis". *Electrophoresis* (2000), 21:2859-2865.
Lee, Edgar D. et al., "On-line capillary zone electrophoresis-ion spray tandem mass spectrometry for the determination of dynorphins". *Journal of Chromatography* (1988), 458:313-321.
Moini, Mehdi, "Design and performace of a universal sheathless capillary electrophoresis to mass spectrometry interface using a spit-flow technique". *Anal. Chem.* (2001), 73:3497-3501.
Neusub, Christian et al., "A robust approach for the analysis of peptides on the low femtomole range by capillary electrophoresis-tandem mass spectrometry". *Electrophoresis* (2002), 23:3149-3159.
Olivares, Jose A. et al., "On-line mass spectrometric detection for capillary zone electrophoresis". *Anal. Chem.* (1987), 59:1230-1232.
Paroni, Rita et al., "Creatinine determination in serum by capillary electrophoresis". *Electrophoresis* (2004), 25:463-468.
Rohde, E. et a;., "Comparison of protein mixtures in aqueous humor by membrane preconcentration—capilliary electrophoresis—mass spectrometry". *Electrophoresis* (1998), 19:2361-2370.
Sanz-Nebot, Victoria et al., "Capillary electrophoresis coupled to time of flight-mass spectrometry of therapeutic peptide hormones". *Electrophoresis* (2003), 24:883-891.
Smith, Richard D. et al., "Capillary zone electrophoresis-mass spectrometry using an electrospray ionization interface". *Anal. Chem.* (1988), 60:436-441.
Smith, Richard D. et al., "New developments in biochemical mass spectrometry : electrospray ionization", *Anal. Chem.* (1990), 62:882-899.
Stroink, Thom et al., "On-line coupling of size exclusion and capillary zone electrophoresis via a cerebrospinal fluid". *Electrophoresis* (2003), 24:897-903.
Temples, F.W. Alexander et al., "Chromatographic preconcentration coupled to capillary electrophoresis via an in-line injection valve". *Anal. Chem.* (2004), 76:4432-4436.
Tomilson, Andy J. et al., "Systematic development of on-line membrane preconcentration -capillary electrophoresis-mass spectrometry for the analysis of peptide mixtures". *Journal of Capillary Electrophoresis* (Sep./Oct. 1995),2(5): 225-233.
Valaskovic, Gary A. et al., "Automated orthogonal control system for electrospray ionization". *Journal of the American Society for Mass Spectrometry* (Aug. 2004), 15(8):1201-1215.
Valaskovic, Gary A. et al., "Automated orthogonal control system for electrospray ionization mass spectrometry". ASMS COnference on Mass Spectrometry and Allied Topics held on May 23-27, 2004, *New Objective, Inc.* (2004):1-5, Nashville TN.
Villanueva, Josep et al., "Serum peptide profiling by magnetic particle-assisted, automated sample processing and MALDI-TOF mass spectrometry". *Anal. Chem.* (Mar. 15, 2004), 76(6):1560-1570.
Von Brocke, Alexander et al., "Recent advances in capillary electrophoresis/electrospray-mass spectrometry". *Electrophoresis* (2001), 22:1251-1266.
Whitt, Jacob T. et al., "Capillary electrophoresis to mass spectrometry interface using a porous junction". *Anal. Chem.* (May 1, 2003), 75(9):2188-2191.
Wittke, Stefan et al., "Determination of peptides and proteins in human urine with capillary electrophoresis-mass spectrometry, a suitable tool for the establishment of new diagnostic markers". *Journal of Chromatography A* (2003), 1013:173-181.
Zhu, Xiaofeng et al., "A colloidal graphite-coated emitter for sheathless capillary electrophoresis/nanoelectrospray ionization mass spectrometry". *Anal. Chem.* (2002), 74: 5405-5409.
Barnidge, David R. et al., "A design for low-flow sheathless electrospray emitters". *Anal. Chem.* (1999), 71:4115-4118.
Lion, Niels et al., "Flow-rate chacterization of microfabricated polymer microspary emitters". *Rapid Communications in Mass SPectrometry* (2004), 18:1614-1620.
Nilsson, Stefan et al., "A simple and robust conductive graphite coating for sheathless electrospray emitters used in capillary electrophoresis/mass spectrometry". *Rapid Communications in Mass Spectrometry* (2001), 15:1997-2000.
Rossier, Joel S. et al., "Thin-chip microspray system for high-performace fourler-transform ion-cyclotron resonance mass spectrometry of bipolymers". *Agew. Chem. Int Ed.* (2003), 42:53-58.
Wetterhall, Magnus et al., "A conductive polymeric material used for nanospray needle and low-flow sheathless electrospray ionization applications". *Anal. Chem*l. (2002), 74:239-245.
Yarin, A.L. et al., "Taylor cone and jetting from liquid droplets in electrospinning of nanofibers". *Journal of Applied Physics* (2001), 90:4836-4846.
Czaplewski, David A., et al., "Nanofluidic Channels with Elliptical Cross Sections", *Applied Physics Letters*, 83(23), (2003), 4836-4838.
Czaplewski, David A., et al., "Nanomechanical Oscillators Fabricated Using Polymeric Nanofiber Templates", Nano Letters, 4 (2004), 437-439.
Czaplewski, David A., et l., "Nonlithographic Approach to Nanostructure Fabrication Using a Scanned Electrospinning Souce", *Journal of Vacuume Science & Technologu B: Microelectronics and Nanometer Structures*, 121(6), (2003), 2994-2997.
Kameoka, Jun et al., "A Scanning Tip Electrospinning Source for Deposition of Oriented", *Nanotechnology*, 14, (2003), 1124-1129.

Kameoka, Jun, et al., "An Arrow SHaped Silicon Tip for Polymeric Nanofiber Fabrication", *Journal of Photopolymer Science and Technology*, 16, (2003), 423-426.
Kameoka, Jun, et al., "Fabrication of Oriented Polymeric Nanofibers on Planar Surfaces by Electrospinning", *Applied Physics Letters*, 83(2), (Jul. 14, 2003), 371-373.
Kameoka, Jun, et al., "Polymeric Nanowire Architecture", *Journal of Materials Chemistry*, 14, (2004), 1503-1505.
Liu, Haiqing, et al., "Polymeric Nanowire Chemical Sensor", *Nano Letters*, 4, (2004), 671-675.
Yuan, Cheng-Hui, et al., "Sequential Electrospray Analysis Using Sharp-Tip Channe;s Fabricated on a Plastic Chip", *Anal. Chem.* 73, (2001), 1080-1083.
U.S. Appl. No. 10/903,248, filed Jul. 29, 2004, Bousse et al., entitled "Microfluidic Devices with Electrical Contact for STab;e Electrophoresis and Electrospray".
U.S. Appl. No. 11/031,963, filed Jan. 6, 2005, Bousse et al., entitled "Electrospray Apparatus with an Integrated Electrode".
Geracimos, A., "Outwitting Ovarian Cancer". Correlogic Systems, Inc., Press Release dated Apr. 6, 2002, 4 pages.
Sassi, Alexander P., et al., "An automated, sheathless capillary electrophoresis-mass spectrometry platform for discovery of biomarkers in human serum", *Electrophoresis* (2005),26: pages unknown.
Kameoka, et al., U.S. Appl. No. 11/082,329, entitled "Electrospray Emitter for Microfluidic Channel," filed Mar. 17, 2005 (WSGR Reference No. 29191-702.301).
Larsson, et al., U.S. Appl. No. 10/546,117, entitled "Nozzles For Electrospray Ionization And Methods Of Fabricating Them," filed Aug. 19, 2005 (WSGR Reference No. 29191-730.831).

* cited by examiner 104
140
(a)
(b)
Sealing layer with pattern electrode
laser or other precise cutting
108

112
102
120
Microchip with channels and reservior
Lamination (a)
(b)
108/140
pad for electric contact
100

Microchip with channel and reservior

+

MICROFLUIDIC DEVICES AND METHODS

BACKGROUND OF THE INVENTION

The present invention relates generally to medical devices and methods, chemical and biological sample manipulation, spectrometry, drug discovery, and related research. More specifically, the invention relates to an interface between microfluidic devices and a mass spectrometer.

The use of microfluidic devices such as microfluidic chips is becoming increasingly common for such applications as analytical chemistry research, medical diagnostics and the like. Microfluidic devices are generally quite promising for applications such as proteomics and genomics, where sample sizes may be very small and analyzed substances very expensive. One way to analyze substances using microfluidic devices is to pass the substances from the devices to a mass spectrometer (MS). Such a technique benefits from an interface between the microfluidic device and the MS, particularly MS systems that employ electrospray ionization (ESI).

Electrospray ionization generates ions for mass spectrometric analysis. Some of the advantages of ESI include its ability to produce ions from a wide variety of samples such as proteins, peptides, small molecules, drugs and the like, and its ability to transfer a sample from the liquid phase to the gas phase, which may be used for coupling other chemical separation methods, such as capillary electrophoresis (CE), liquid chromatography (LC), or capillary electrochromatography (CEC) with mass spectrometry. Devices for interfacing microfluidic structures with ESI MS sources currently exist, but these existing interface devices have several disadvantages.

One drawback of currently available microfluidic MS interface structures is that they typically make use of an ESI tip attached to the microfluidic substrate. These ESI tips are often sharp, protrude from an edge of the substrate used to make the microfluidic device, or both. Such ESI tips are both difficult to manufacture and easy to break or damage. Creating a sharp ESI tip often requires sawing each microfluidic device individually or alternative, equally labor intensive manufacturing processes. Another manufacturing technique, for example, involves inserting a fused-silica capillary tube into a microfluidic device to form a nozzle. This process can be labor intensive, with precise drilling of a hole in a microfluidic device and insertion of the capillary tube into the hole. The complexity of this process can make such microfluidic chips expensive, particularly when the microfluidic device is disposable which leads to concern over cross-contamination of substances analyzed on the same chip.

Other currently available microfluidic devices are manufactured from elastomers such as polydimethylsiloxane (PDMS) and other materials that provide less fragile tips than those just described. These types of materials, however, are generally not chemically resistant to the organic solvents typically used for electrospray ionization.

Another drawback of current microfluidic devices involve dead volume at the junction of the capillary tube with the rest of the device. Many microfluidic devices intended for coupling to a mass spectrometer using an ESI tip have been fabricated from fused silica, quartz, or a type of glass such as soda-lime glass or borosilicate glass. The most practical and cost-effective method currently used to make channels in substrates is isotropic wet chemical etching, which is very limited in the range of shapes it can produce. Plasma etching of glass or quartz is possible, but is still too slow and expensive to be practical. Sharp shapes such as a tip cannot readily be produced with isotropic etching, and thus researchers have resorted to inserting fused-silica capillary tubes into glass or quartz chips, as mentioned above. In addition to being labor-intensive, this configuration can also introduce a certain dead volume at the junction, which will have a negative effect on separations carried out on the chip.

Some techniques for manufacturing microfluidic devices have attempted to use the flat edge of a chip as an ESI emitter. Unfortunately, substances would spread from the opening of the emitter to cover much or all of the edge of the chip, rather than spraying in a desired direction and manner toward an MS device. This spread along the edge causes problems such as difficulty initiating a spray, high dead volume, and a high flow rate required to sustain a spray.

Another problem sometimes encountered in currently available microfluidic ESI devices is how to apply a potential to substances in a device with a stable ionization current while minimizing dead volume and minimizing or preventing the production of bubbles in the channels or in the droplet at the channel outlet. A potential may be applied to substances, for example, to move them through the microchannel in a microfluidic device, to separate substances, to provide electrospray ionization, or typically a combination of all three of these functions. Some microfluidic devices use a conductive coating on the outer surface of the chip or capillary to achieve this purpose. The conductive coating, however, often erodes or is otherwise not reproducible. Furthermore, bubbles are often generated in currently available devices during water electrolysis and/or redox reactions of analytes. Such bubbles adversely affect the ability of an ESI device to provide substances to a mass spectrometer in the form of a spray having a desired shape.

Therefore, it would be desirable to have microfluidic devices which provide electrospray ionization of substances to mass spectrometers and which are easily manufactured. Ideally, such microfluidic devices would include means for electrospray ionization that provide desired spray patterns to an MS device and that could be produced by simple techniques such as dicing multiple microfluidic devices from a common substrate. In addition to being easily manufactured, such microfluidic devices would also ideally include means for emitting substances that do not include protruding tips that are easily susceptible to breakage. Also ideally, microfluidic devices would include means for providing a charge to substances without generating bubbles and while minimizing dead volume. At least some of these objectives will be met by the present invention.

BRIEF SUMMARY OF THE INVENTION

Improved microfluidic devices and methods for making and using such devices provide one or more substances to a mass spectrometer for analysis. The microfluidic devices generally include first and second surfaces, at least one microchannel, and an outlet at an edge of the surfaces which is recessed back from an adjacent portion of the edge. Some embodiments include one or more hydrophilic surfaces and/or hydrophobic surfaces to help guide substances out of the outlet to provide the substances to a mass spectrometer in a desired configuration, direction or the like. Some embodiments include a protruding tip that is recessed from the adjacent edge of the surfaces. Such a tip may help guide the substances while remaining resistant to breakage due to its recessed position. To further enhance the delivery of substances, some embodiments include a source of electrical potential to move substances through a microchannel, separate substances and/or provide electrospray ionization.

In one aspect of the invention, a microfluidic device for providing one or more substances to a mass spectrometer for analysis of the substances comprises: a microfluidic body having first and second major surfaces with an edge surface therebetween; at least one microchannel disposed between the first and second major surfaces, the microchannel having a microfabricated surface; and an outlet in fluid communication with the microchannel and disposed along the edge surface, the outlet recessed into the microfluidic body relative to an adjacent portion of the edge surface.

In some embodiments, at least part of the microfabricated surface comprises a hydrophilic surface. Hydrophilic surfaces can minimize or inhibit protein binding. As inhibiting of protein binding may be beneficial, in many embodiments at least a portion of the microfabricated surface may comprise a surface which minimizes or inhibits protein binding. The hydrophilic surface, for example, may comprise simply a part of the microfabricated surface adjacent the outlet. In other embodiments, the hydrophilic surface is disposed along the entire length of the microfabricated surface. Some examples of hydrophilic surfaces include a coated surface, a gel matrix, a polymer, a sol-gel monolith and a chemically modified surface. Coatings, for example, may include but are not limited to cellulose polymer, polyacrylamide, polydimethylacrylamide, acrylamide-based copolymer, polyvinyl alcohol, polyvinylpyrrolidone, polyethylene oxide, Pluronic™ polymers or poly-N-hydroxyethylacrylamide, Tween™ (polyoxyethylene derivative of sorbitan esters), dextran, a sugar, hydroxyethyl methacrylene, and indoleactic acid. A variety of methods are known to modify surfaces to make them hydrophilic (see e.g., Doherty et al, Electrophoresis, vol. 24, pp. 34–54, 2003). For instance, an initial derivatization, often using a silane reagent, can be followed by a covalently bound coating of a polyacrylamide layer. This layer can be either polymerized in-situ, or preformed polymers may be bound to the surface. Examples of hydrophilic polymers that have been attached to a surface in this way include polyacrylamide, polyvinylpyrrolidone, and polyethylene oxide. Another method of attaching a polymer to the surface is thermal immobilization, which has been demonstrated with polyvinyl alcohol. In many cases, it is sufficient to physically adsorb a polymeric coating to the surface, which has been demonstrated with cellulose polymers, polyacrylamide, polydimethylacrylamide, polyvinyl alcohol, polyvinylpyrrolidone, polyethylene oxide, Pluronic™ polymers (PEO-PPO-PEO triblock copolymers), and poly-N-hydroxyethylacrylamide. Certain techniques of surface modification are specific to polymer surfaces, for instance alkaline hydrolysis, or low-power laser ablation.

Optionally, the first major surface, the second major surface and/or the edge surface may include, at least in part, a hydrophobic surface. In some embodiments, for example, the hydrophobic surface is disposed adjacent the outlet. For example, the hydrophobic material may comprise an alkylsilane which reacts with a given surface, or coatings of cross-linked polymers such as silicone rubber (polydimethylsiloxane). The hydrophobic character of the polymer material may optionally be rendered hydrophilic by physical or chemical treatment, such as by gas plasma treatment (using oxygen or other gases), plasma polymerization, corona discharge treatment, UV/ozone treatment, or oxidizing solutions.

Any suitable materials may be used, but in one embodiment the first and/or second major surfaces comprise a material such as glass, silicon, ceramic, polymer, copolymer, silicon dioxide, quartz, silica or a combination thereof. The polymer, for example, may include cyclic polyolefin, polycarbonate, polystyrene, PMMA, acrylate, polyimide, epoxy, polyethylene, polyether, polyethylene terephtalate, polyvinyl chloride, polydimethylsiloxane, polyurethane, polypropylene, phenol formaldehyde, polyacrylonitrile, Mylar™ (polyester) or Teflon™ (PTFE). Some embodiments also include at least one protrusion extending at least one surface of the microchannel beyond the outlet, the protrusion recessed into the microfluidic body relative to the adjacent portion of the edge surface. In some embodiments the protrusion comprises at least one hydrophilic surface, while in others it may comprise a metallic surface or a hydrophobic surface. Sometimes the protrusion comprises a pointed tip, and rounded (optionally being semi-circular) tops with a radius of 40 micrometers or less can also be employed.

Optionally, an embodiment may include a source of pressure, such as hydrodynamic, centrifugal, osmotic, electroosmotic, electrokinetic, pneumatic or the like, coupled with the device to move the substances through the microchannel. Alternatively, the device may include an electrical potential source coupled with the device to move the substances through the microchannel. For example, the electrical potential source may comprise an electrical potential microchannel in fluid communication with the microchannel, the electrical potential microchannel containing at least one electrically charged substance. In other embodiments, the electrical potential source comprises an electrical potential microchannel which exits the microfluidic device immediately adjacent the microchannel, the electrical potential microchannel containing at least one electrically charged substance. In yet another embodiment, the electrical potential source comprises at least one electrode. In some embodiments, each electrode acts to separate the substances and to provide electrospray ionization. In others, each electrode acts to move the substances in the microchannel and to provide electrospray ionization. Such electrodes may comprise, for example, copper, nickel, conductive ink, silver, silver/silver chloride, gold, platinum, palladium, iridium, aluminum, titanium, tantalum, niobium, carbon, doped silicon, indium tin oxide, other conductive oxides, polyanaline, sexithiophene, polypyrrole, polythiophene, polyethylene dioxythiophene, carbon black, carbon fibers, conductive fibers, and other conductive polymers and conjugated polymers. In some embodiments the at least one electrode generates the electrical potential without producing a significant quantity of bubbles in the substances.

In another aspect, a microfluidic device for providing one or more substances to a mass spectrometer for analysis of the substances comprises: a microfluidic body having first and second major surfaces with an edge surface therebetween; at least one microchannel disposed between the first and second major surfaces, the microchannel having a microfabricated surface; an outlet in fluid communication with the microchannel and disposed along the edge surface, the outlet recessed into the microfluidic body relative to an adjacent portion of the edge surface; and a protruding tip separated from the outlet and disposed in a path of fluid flow from the outlet, the protruding tip recessed into the microfluidic body relative to the adjacent portion of the edge surface.

In yet another aspect, a microfluidic device for providing one or more substances to a mass spectrometer for analysis of the substances comprises: a substrate comprising at least one layer, the substrate including at least one protruding tip and at least one microchannel, wherein the microchannel comprises at least one hydrophilic surface and the substances are movable within the microchannel; a cover arranged over the substrate, the cover comprising a bottom surface at least partially contacting the substrate and a top surface; and an outlet in fluid communication with the microchannel for allowing egress of the substances from the microchannel, wherein at least one of the substrate and the cover comprises at least one hydrophobic surface.

In some embodiments, the protruding tip extends through an aperture in the cover but does not extend beyond the top surface of the cover. Also in some embodiments, the microfluidic channel passes through the protruding tip. Alternatively, the outlet may be disposed adjacent the protruding tip. Optionally, at least part of the protruding tip comprises a hydrophilic surface to direct substances along the tip. Also optionally, at least part of cover near the outlet comprises a hydrophilic surface. The outlet may have any suitable size, but in one embodiment it has a cross-sectional dimension (typically a width, height, effective diameter, or diameter) of between about 0.1 $\mu$m and about 500 $\mu$ms. In many embodiments the outlet has a cross-sectional dimension of between about 50 $\mu$m and about 150 $\mu$ms, in others between about 1 and 5 $\mu$ms, and in still others between about 5 and 50 $\mu$ms.

In another embodiment, a microfluidic device for providing one or more substances to a mass spectrometer for analysis of the substances comprises: a microfluidic body having first and second major surfaces and at least one edge surface; at least one microchannel disposed between the first and second major surfaces, the microchannel having a microfabricated surface; and a layer of film disposed between the first and second major surfaces to form at least one tip, the tip in fluid communication with the microchannel and recessed into the microfluidic body relative to an adjacent portion of the edge surface. The layer of film may comprise any suitable material, but in some embodiments will comprise a polymer, such as but not limited to cyclic polyolefin, polycarbonate, polystyrene, PMMA, acrylate, polyimide, epoxy, polyethylene, polyether, polyethylene terephtalate, polyvinyl chloride, polydimethylsiloxane, polyurethane, polypropylene, phenol formaldehyde, polyacrylonitrile, Mylar™ or Teflon™. In some embodiments, the polymer is at least partially coated with at least one conductive material, such as but not limited to a material comprising copper, nickel, conductive ink, silver, silver/silver chloride, gold, platinum, palladium, iridium, aluminum, titanium, tantalum, niobium, carbon, doped silicon, indium tin oxide, a conductive oxide, polyaniline, sexithiophene, conductive fibers, conductive polymers and conjugated polymers.

In some embodiments of the device, the tip is disposed along a recessed portion of the edge. Also in some embodiments, the layer of film and at least one of the first and second major surfaces comprise complementary alignment features for providing alignment of the major surface(s) with the layer of film.

In still another aspect, a method of making a microfluidic device for providing one or more substances to a mass spectrometer for analysis of the substances involves fabricating a substrate comprising at least one microchannel having a microfabricated surface and an outlet in fluid communication with the microchannel and disposed along an edge surface of the substrate, the outlet recessed into the substrate relative to an adjacent portion of the edge surface, and applying a cover to the substrate.

In some embodiments, at least part of the microfabricated surface comprises a hydrophilic surface and/or a surface that inhibits or minimizes protein binding. For example, forming the microchannel may comprise applying a hydrophilic coating to the microfabricated surface. Applying the coating may involve, for example, introducing the coating into the microchannel under sufficient pressure to advance the coating to the outlet. In some embodiments, at least one of the substrate and the cover comprises, at least in part, a hydrophobic surface and/or a surface that minimizes or inhibits protein binding.

Some embodiments further comprise forming at least one protrusion extending at least one surface of the microchannel beyond the outlet, the protrusion recessed into the substrate relative to the adjacent portion of the edge surface. In some embodiments, the protrusion comprises at least one hydrophilic surface. Some methods also include coupling a source of pressure or an electrical potential source with the device to move the substances through the microchannel, separate substances, and/or provide electrospray ionization. Such electrical potential sources have been described fully above.

Some embodiments also include making at least two microfluidic devices from a common piece of starting material and separating the at least two microfluidic devices by cutting the common piece. In some embodiments, the microchannel is formed by at least one of photolithographically masked wet-etching, photolithographically masked plasma-etching, embossing, molding, injection molding, photoablating, micromachining, laser cutting, milling, and die cutting.

In still another aspect, a method for making a microfluidic device for providing one or more substances to a mass spectrometer for analysis of the substances comprises: fabricating a microfluidic body comprising: first and second major surfaces with an edge surface therebetween; at least one microchannel disposed between the first and second major surfaces, the microchannel having a microfabricated surface; and an outlet in fluid communication with the microchannel and disposed along the edge surface, the outlet recessed into the microfluidic body relative to an adjacent portion of the edge surface. Some embodiments further include fabricating a protruding tip separated from the outlet and disposed in a path of fluid flow from the outlet, the protruding tip recessed into the microfluidic body relative to the adjacent portion of the edge surface. In some cases, at least one of the first major surface, the second major surface and the protruding tip includes a hydrophobic surface. Optionally, at least part of the microfabricated surface may comprise a hydrophilic surface.

In another aspect, a method for providing at least one substance from a microfluidic device into a mass spectrometer comprises moving the at least one substance through at least one microchannel in the microfluidic device and causing the at least one substance to pass from the microchannel out of an outlet at an edge of the microfluidic device. In one embodiment, the substance is moved through at least one microchannel by applying an electrical potential to the substance. Such an embodiment may further include using the electrical potential to separate one or more substances. In some embodiments, applying the electrical potential to the substance does not generate a significant amount of bubbles in the substance. In another embodiment, the substance is moved through at least one microchannel by pressure.

In some embodiments, causing the substance to pass from the microchannel out of the outlet comprises directing the substance with at least one of a hydrophobic surface and a hydrophilic surface of the microfluidic device. In some embodiments, causing the substance to pass from the microchannel out of the outlet may comprise directing the substance out of the outlet in a direction approximately parallel to a longitudinal axis of the at least one microchannel.

Alternatively, causing the substance to pass from the microchannel out of the outlet may comprise directing the substance out of the outlet in a direction non-parallel to a longitudinal axis of the at least one microchannel. In some cases, causing the substance to pass from the microchannel out of the outlet comprises directing the substance out of the outlet in the form of a spray having any desired shape or configuration.

In yet another aspect, a method of making microfluidic devices for providing one or more substances to a mass spectrometer for analysis of the substances involves: forming at least one microchannel on a first substrate; forming a recessed edge on the first substrate and a second substrate; providing a layer of film having at least one tip and at least one alignment feature; aligning the layer of film between the first and second substrates; and bonding the layer of film between the first and second substrates. In some embodiments, forming the at least one microchannel comprises embossing the microchannel onto the first substrate. Also in some embodiments, forming the recessed edge comprises drilling a semi-circular recession into an edge of the first substrate and the second substrate.

In some embodiments, providing the layer of film comprises providing a polymer film, such as but not limited to a film of cyclic polyolefin, polycarbonate, polystyrene, PMMA, acrylate, polyimide, epoxy, polyethylene, polyether, polyethylene terephtalate, polyvinyl chloride, polydimethylsiloxane, polyurethane, polypropylene, phenol formaldehyde, polyacrylonitrile, Mylar™ or Teflon™. Also in some embodiments, the polymer is at least partially coated with at least one conductive material, such as but not limited to a material comprising copper, nickel, conductive ink, silver, silver/silver chloride, gold, platinum, palladium, iridium, aluminum, titanium, tantalum, niobium, carbon, doped silicon, indium tin oxide, other conductive oxides, polyanaline, sexithiophene, polypyrrole, polythiophene, polyethylene dioxythiophene, carbon black, carbon fibers, conductive fibers, and other conductive polymers and conjugated polymers.

Providing the layer of film, in some embodiments, comprises forming the at least one tip and the at least one alignment feature using at least one of laser cutting, die-cutting or machining, though any other suitable technique may be used. Some embodiments further include forming at least one complementary alignment feature on at least one of the first and second substrates to provide alignment of the layer of film with the first and second substrates. Aligning may involve aligning the at least one alignment feature on the layer of film with at least one complementary alignment feature on at least one of the first and second substrates. Bonding may involve, for example, thermally bonding the first substrate to the second substrate with the layer of film disposed in between, though any other suitable technique may be used. Also, some embodiments may further involve separating the bonded first substrate, second substrate and layer of film to produce multiple microfluidic devices.

DETAILED DESCRIPTION OF THE INVENTION

Improved microfluidic devices and methods for making and using such devices provide one or more substances to a mass spectrometer for analysis. The microfluidic devices generally include first and second surfaces, at least one microchannel formed by the surfaces, and an outlet at an edge of the surfaces which is recessed back from an adjacent portion of the edge. Some embodiments include one or more hydrophilic surfaces and/or hydrophobic surfaces to help guide substances out of the outlet to provide the substances to a mass spectrometer in a desired configuration, direction or the like. Hydrophilic surfaces may minimize or inhibit protein binding, which may also be beneficial, so that alternative surfaces which inhibit protein binding may also be employed in place of the hydrophilic surfaces described herein. Some embodiments include a protruding tip that is recessed from the adjacent edge of the surfaces. Such a tip may help guide the substances while remaining resistant to breakage due to its recessed position. To further enhance the delivery of substances, some embodiments include a source of electrical potential to move substances through a microchannel, separate substances and/or provide electrospray ionization.

The invention is not limited to the particular embodiments of the devices described or process steps of the methods described as such devices and methods may vary. Thus, the following description is provided for exemplary purposes only and is not intended to limit the invention as set forth in the appended claims.

Figure 1:
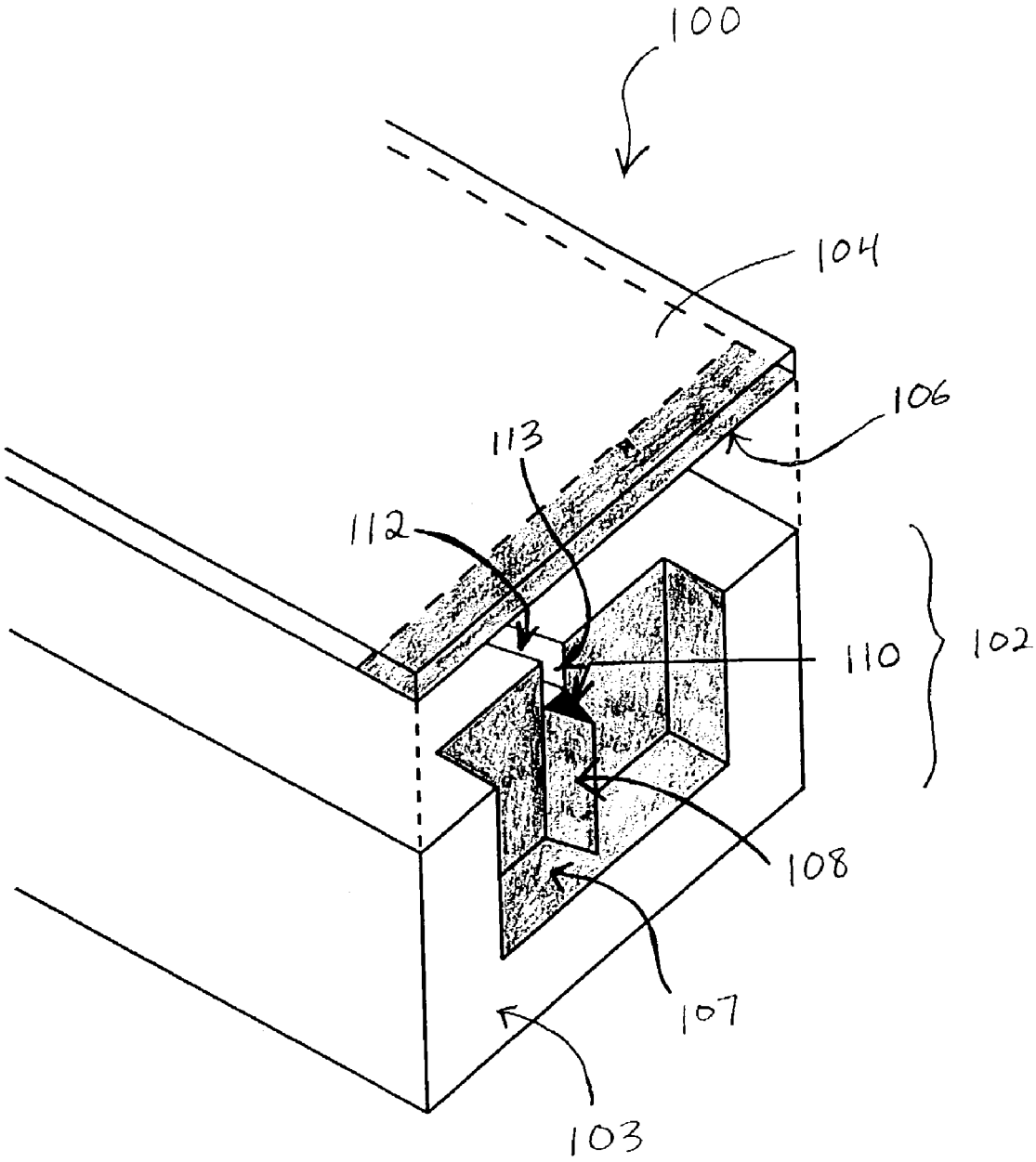
FIG. 1 is a perspective view of a portion of a microfluidic device having a recessed outlet according to an embodiment of the present invention.

Referring now to FIG. 1, a portion of a microfluidic device 100 comprising a substrate 102 and a cover 104 is shown. (FIG. 1A shows an example of a complete substrate 102 of such a device, according to one embodiment.) The term "substrate" as used herein refers to any material that can be microfabricated (e.g., dry etched, wet etched, laser etched, molded or embossed) to have desired miniaturized surface features, which may be referred to as "microstructures." Microfabricated surfaces can define these microstructures and other, optionally larger structures. Microfabricated surfaces and surface portions can benefit from a dimensional tolerance of 100 μms or less, often being 10 μms or less, the tolerances of the microfabricated surfaces and surface portions more generally being significantly tighter than provided by dicing (substrate cutting or separating) techniques that may define adjacent portions and surfaces. Examples of microstructures include microchannels and reservoirs, which are described in further detail below. Microstructures can be formed on the surface of a substrate by adding material, subtracting material, a combination of both, pressing, or the like. For example, polymer channels can be formed on the surface of a glass substrate using photo-imageable polyimide. Substrate 102 may comprise any suitable material or combination of materials, such as but not limited to a polymer, a ceramic, a glass, a metal, a composite thereof, a laminate thereof, or the like. Examples of polymers include, but are not limited to, polyimide, polycarbonate, polyester, polyamide, polyether, polyolefin, polymethyl methacrylates, polyurethanes, polyacrylonitrile-butadiene-styrene copolymers, polystyrene, polyfluorcarbons, and combinations thereof. Furthermore, substrate 102 may suitable comprise one layer or multiple layers, as desired. When multiple substrate layers are provided, the layers will often be bonded together. Suitable bonding methods may include application of a combination of pressure and heat, thermal lamination, pressure sensitive adhesive, ultrasonic welding, laser welding, and the like. Generally, substrate 102 comprise any suitable material(s) and may be microfabricated by any suitable technique(s) to form any desired microstructure(s), shape, configuration and the like.

Cover 104 generally comprises any suitable material, such as the materials described above in reference to substrate 102. Thus, cover 104 may comprise a polymer, a ceramic, a glass, a metal, a composite thereof, a laminate thereof, or any other suitable material or combination. As is described further below, in various embodiments cover 104 may comprise a simple, planar component without notable surface features, or may alternatively have one or more surface features, outlets or the like. In FIG. 1, cover 104 is raised up off of substrate 102 to enhance visualization of device 100.

In some embodiments, substrate 102 includes a microchannel 112, which is in fluid communication with an outlet 113. Microchannel 112 (as with all microfluidic channels described herein) will often have at least one cross-sectional dimension (such as width, height, effective diameter or diameter) of less than 500 μm, typically in a range from 0.1 μm to 500 μm. Substrate 102 may include a plurality of such channels, the channels optionally defining one, two, or more than two intersections. Typically, substances are moved through microchannel 112 by electric charge, where they also may be separated, and the substances then exit device 100 via outlet 113 in the form of an electrospray directed towards a mass spectrometer or other device. In some embodiments, outlet 113 may be located in a recessed area 107, which is recessed from an edge 103 of device 100. Recessed area 107 generally serves the purpose of protecting an ESI tip 108, which extends beyond outlet 113, from being damaged or broken during manufacture or use. ESI tip 108, in some embodiments, may include a hydrophilic surface 110, such as a metalized surface, which may help form a desirable configuration of an electrospray, such as a Taylor cone.

Microfluidic device 100 generally includes at least one hydrophilic surface 110 and at least one hydrophobic surface (shaded area and 106). Either type of surface may be used in portions of substrate 102, cover 104 or both. Generally, such hydrophilic and hydrophobic surfaces can allow substances to be sprayed from device 100 in a desired manner. In FIG. 1, for example, a portion of cover 104 comprises a hydrophobic surface 106 facing toward substrate 102 and microchannel 112. All the surface of recessed area 107 is also hydrophobic. These hydrophobic surfaces (all shaded) prevent fluidic substances exiting outlet 113 from spreading along an edge or surface of device 100 rather than spraying toward a mass spectrometer as desired. At the same time, hydrophilic surface 110 and a microchannel having a hydrophilic surface may help keep fluidic substances generally moving along a desired path defined by the microchannel and hydrophilic surface 110. This combination of hydrophilic and hydrophobic surfaces is used to enhance ESI of substances to a devices such as a mass spectrometer.

Referring now to FIG. 1A, a top view of one embodiment of substrate 102 is shown. Microstructures on substrate 102 may include any combination and configuration of structures. In one embodiment, for example, a reservoir 120 for depositing substances is in fluid communication with microchannel 112 which leads to outlet. Some embodiments further include a second reservoir 122 wherein an electrically charged material may be deposited. This electrically charged material may be used to apply a charge to substances in microchannel 112 via a side-channel 124. Typically, side-channel 124 will have a smaller cross-sectional dimension than microchannel 112, so that substances will not tend to flow up side-channel. Electric charge is applied to substances in microfluidic device 100 for both the purposes of separating substances and providing ESI.

Figure 1B:
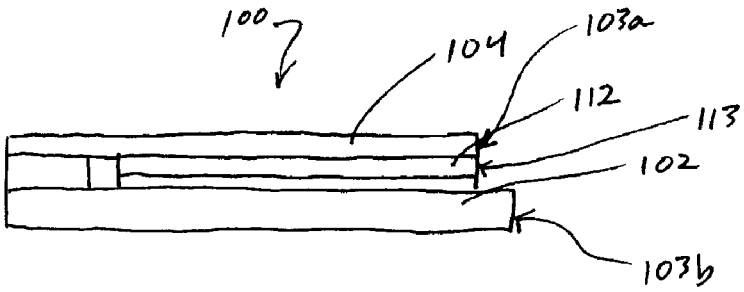
FIG. 1B is a side view of a microfluidic device having a recessed outlet according to an embodiment of the present invention.
Figure 1A:
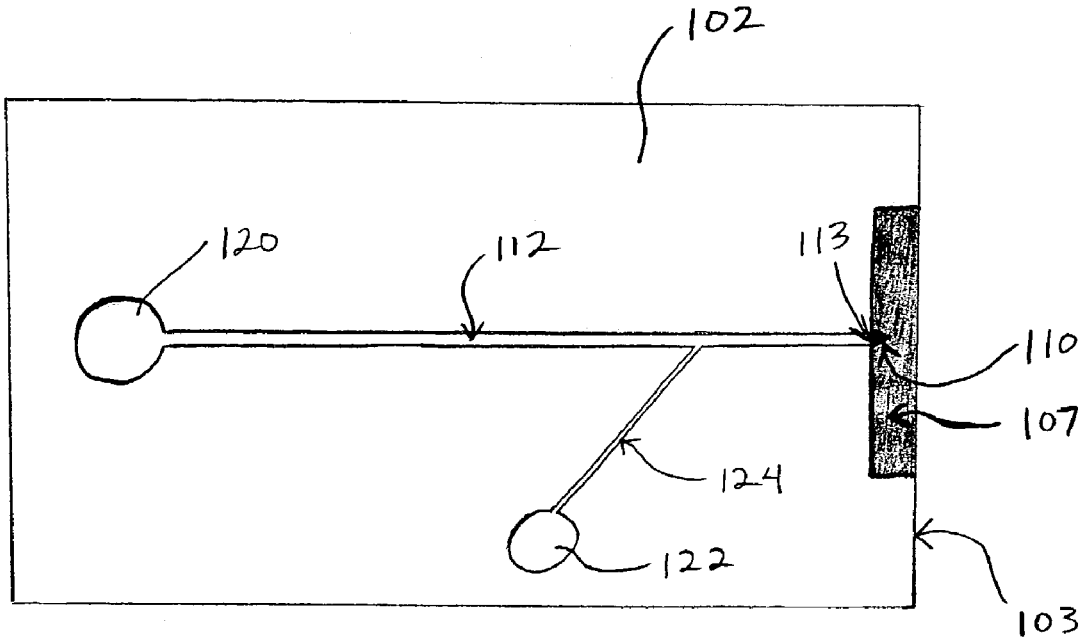
FIG. 1A is a top view of a substrate of a microfluidic device having a recessed ESI tip, such as the device shown in FIG. 1, according to an embodiment of the present invention.

Referring to FIG. 1B, a side view of another embodiment of microfluidic device 100 is shown. This embodiment demonstrates that outlet 113 may be disposed along an edge 103*a* of device 100 while at the same time being recessed from an adjacent edge portion 103*b*. Edge 103*a* where outlet 113 is located may be more finely manufactured compared to adjacent edge portion 103*b*, which may be roughly cut or otherwise manufactured via a less labor intensive process.

Figure 2A:
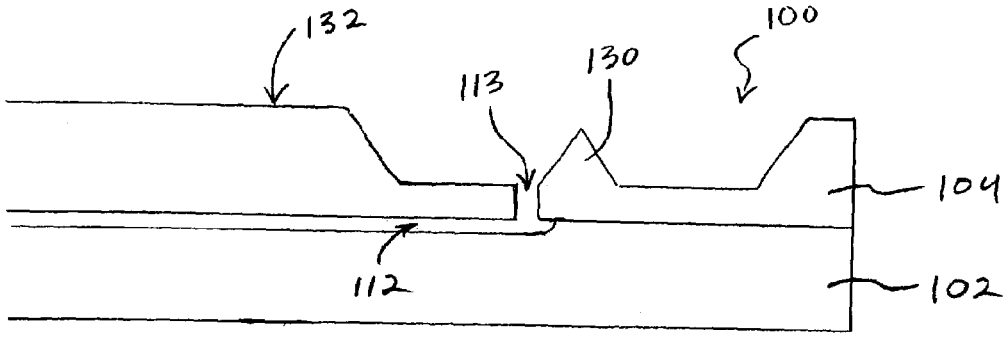
FIG. 2A is a side, cross-sectional view of a microfluidic device having a cover with an outlet and an adjacent surface feature according to an embodiment of the present invention.

Referring now to FIG. 2A, in some embodiments substrate 102 and cover 104 of device 100 comprise generally planar surfaces, with cover 104 disposed on top of substrate 102. Cover 102 may include one or more surface features 130 and an outlet 113 which, like outlet shown in previous figures, is in fluid communication with microchannel 112. In some embodiments, surface feature 130 is recessed, such that it does not extend beyond a top-most surface 132 of device 100. This protects surface feature 130 from damage. Generally, substrate 102 and cover 104 may be made from any suitable materials and by any suitable manufacturing methods. In one embodiment, for example, substrate 102 is embossed or molded with a pattern of microchannels 112 having typical microfluidic dimensions, while cover 104 is embossed or machined with a tool made from a silicon master. This process allows device 100 to be manufactured via standard anisotropic etching techniques typically used for etching a silicon wafer.

Outlet 113 is typically placed in cover 104 adjacent to or nearby surface feature 130 and may be made in cover 104 using any suitable method. Ideally, the effective diameter, diameter, width, and/or height of outlet 113 is as small as possible to reduce dead volume which would degrade the quality of any separation of substances which had been accomplished upstream of outlet 113. The term "dead volume" refers to undesirable voids, hollows or gaps created by the incomplete engagement, sealing or butting of an outlet with a microchannel. In some embodiments, for example, outlet 113 has a cross-sectional dimension (as above, often being width, height, effective diameter, or diameter) of between about 20 μms and about 200 μms and preferably between about 50 μms and about 150 μms. Outlet 113 may be formed, for example, by microdrilling using an excimer laser in an ultraviolet wavelength, though any other suitable method may be substituted. In another embodiment, outlet 113 may be made by positioning a pin in the desired location for outlet 113 in a mold and then making device 100 via injection molding.

In some embodiments of a microfluidic device 100 as shown in FIG. 2A, hydrophobic and/or hydrophilic surfaces are used to enhance ESI of substances out of device 100. In one embodiment, for example, the surface of cover 104 that forms outlet 113 as well as at least a portion of the surface of surface feature 130 are both relatively hydrophilic, and/or both inhibit protein binding. This hydrophilicity helps guide substances out of outlet 113 and along surface feature 130 toward a mass spectrometer or other device. In one embodiment, the hydrophilic surfaces are formed by an oxygen plasma, masked by a resist layer so that its effect is localized. In another embodiment, a thin film of hydrophilic polymer or surface coating may be deposited, for example by using a device such as a capillary tube filled with the solution of interest. The hydrophilic polymer or surface coating may be disposed through microchannel 112 under sufficient pressure to push the coating just to the outside end of outlet 113, for example, so that the length of microchannel 112 and outlet 113 are coated. Such methods may be used to coat any microchannel 112 and/or outlet 113 with hydrophilic substance(s). In addition to the hydrophilic surface(s) of microchannel 112, outlet 113 and/or surface feature 130, other surfaces of device 100 may be hydrophobic to prevent spreading of substances along a surface. For example, a surface adjacent outlet 113 may be made hydrophobic to prevent such spreading.

Figure 2B:
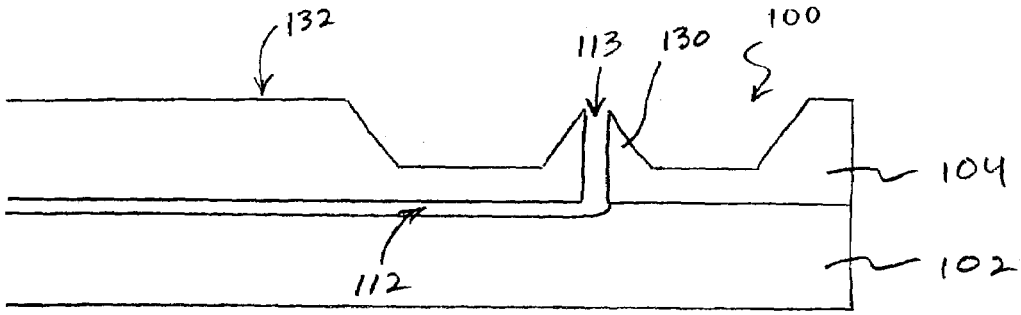
FIG. 2B is a side, cross-sectional view of a microfluidic device having a cover with an outlet passing through a surface feature of the cover according to an embodiment of the present invention.

Referring now to FIG. 2B, in another embodiment outlet 113 passed through surface feature 130. Again, surface feature 130 may be recessed so as to not extend beyond top-most surface 132. Outlet 113 can be formed through surface feature 130 by any suitable means, such as laser ablation drilling.

Figure 2C:
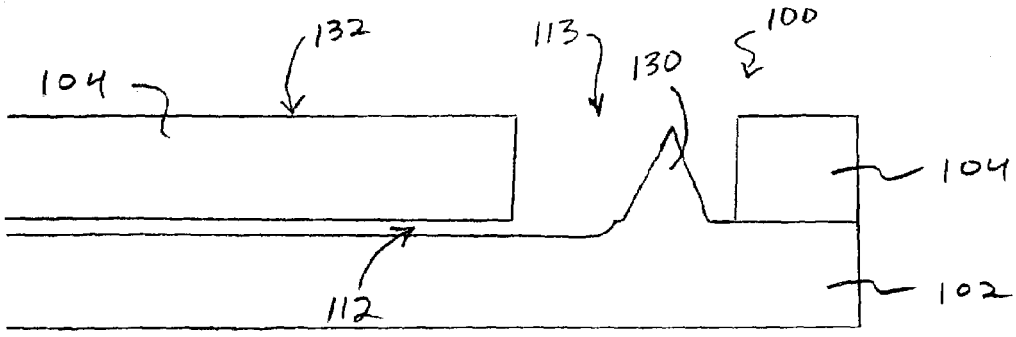
FIG. 2C is a side, cross-sectional view of a microfluidic device having a cover with an outlet and a substrate having a surface feature adjacent the microchannel according to an embodiment of the present invention.

In still another embodiment, as shown in FIG. 2C, cover may not include a surface feature, and instead a surface feature 130 may be formed on substrate 102. This surface feature 130 may be formed by any suitable means, just as when the surface feature is positioned on cover 104. In any of the embodiments, surface feature 130 may have any suitable shape and size, but in some embodiments surface feature 130 is generally pyramidal in shape. Advantageously, forming surface feature 130 on substrate 102 and manufacturing surface feature 130 and microchannel 112 to have hydrophilic surfaces may allow a very simple, planar cover 104 having a relative large outlet 113 to be used. The large outlet 113 is advantageous because it is often difficult to line up (or "register") a small outlet 113 on cover 104 at a desired location above microchannel 112. Improper registration or alignment of cover 104 on substrate 102 may reduce the accuracy of an electrospray and the performance of microfluidic device 100. By manufacturing a device 100 having a cover 104 with a large outlet 113, precise placement of cover 104 on substrate 104 during manufacture becomes less important because there is simply more room for error—i.e., more room for fluid to leave microchannel 112. By using sufficiently hydrophilic surfaces on microchannel 112 and surface feature 130, electrospray ionization of substances may be provided despite the relatively large diameter of outlet 113 as shown in FIG. 2C.

Figure 3A:
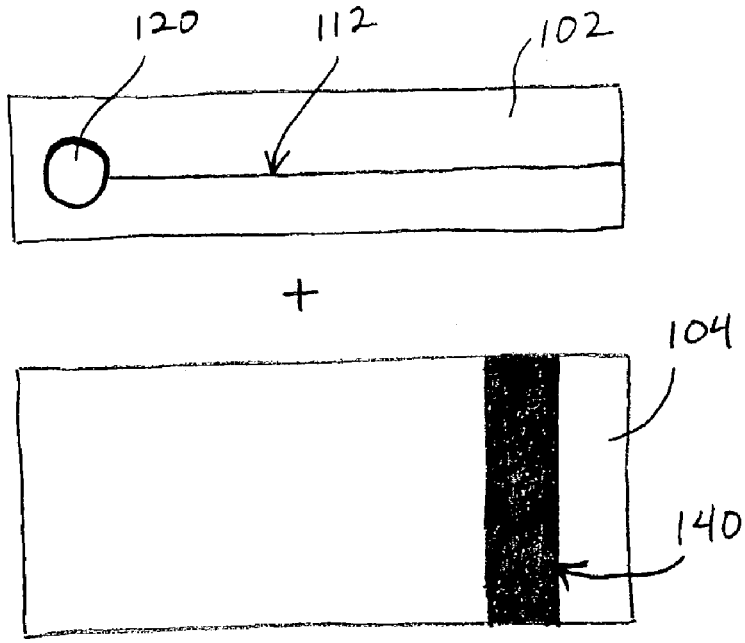
FIGS. 3A–3C are top views depicting a method for making a microfluidic device having a recessed outlet and an electrode according to an embodiment of the present invention.
Figure 3B:
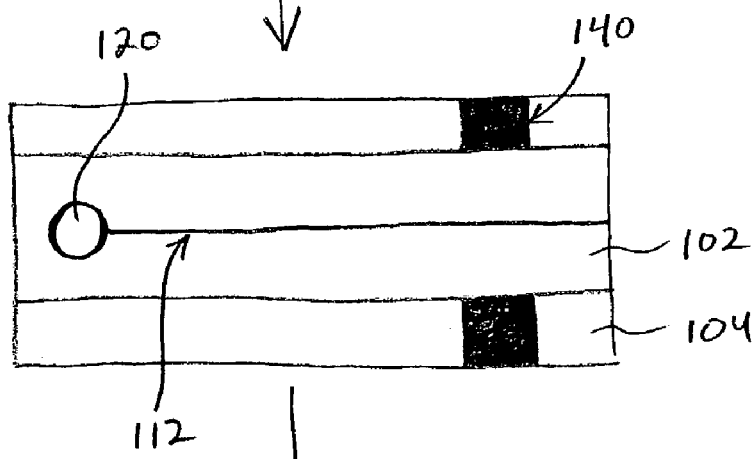
Figure 3C:
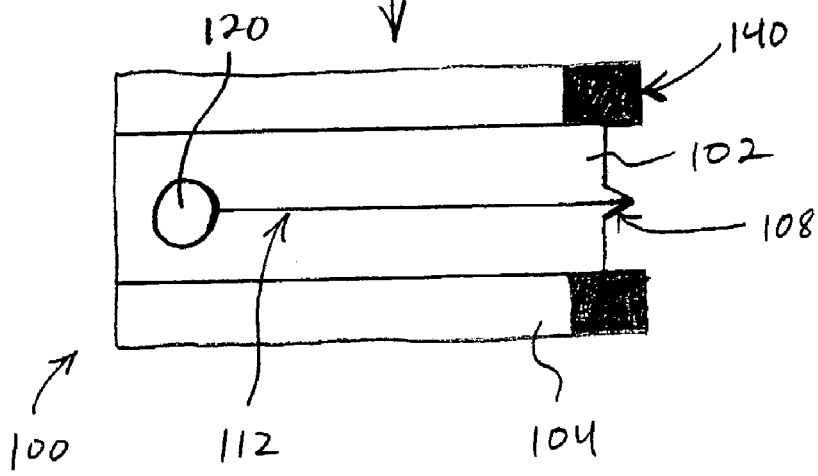

Referring now to FIGS. 3A–3C, a method for making a microfluidic device 100 is shown. In one embodiment, polymer films (for example between 50 μms and 200 μms) or polymer sheets (for example between 200 μms and 2 mm) may be used to form substrate 102 and cover 104 (FIG. 3A). An electrode 140 may be disposed on cover 104 and/or on substrate 102. In some embodiments, electrode 140 comprises a high-voltage electrode capable of acting as both an anode and a cathode for various purposes. For example, in a positive-ion mode, electrode 140 in some embodiments acts as a cathode for capillary electrophoresis separation of substances and as an anode for electrospray ionization. This means that both reduction and oxidation reaction occur in the same electrode, but typically the reduction reaction dominates. Electrode 140 may be formed by depositing one or more metals, printing conductive ink, or otherwise coupling a conductive material with cover 102. In one embodiment, silver or silver chloride may be used, though many other possible materials are contemplated. Generally, using such an electrode 140 to provide electric charge to substances in device 100 avoids generation of bubbles in the substances, as often occurs in currently available devices. Such electrodes also help minimize dead volume and are relatively easy to manufacture and effective to use.

In FIG. 3B, substrate 102 and cover 104 have been coupled together. Often, this is accomplished via a lamination process of cover 104 over substrate 102, but any other suitable method(s) may be used. Finally, in FIG. 3C, microfluidic device 100 is laser cut or otherwise precisely cut to form recessed tip 108. Any suitable method may be used for such precise cutting of tip 108 and the rest of the edge of device 100. In other embodiments, device 100 may be manufactured so as to not include tip 108 at all, but rather to have an outlet that exits from a flat edge. Again, combinations of hydrophilic (and/or protein binding inhibiting) and hydrophobic surfaces may be used to prevent spread of fluid from the outlet along the edge of device 100. Additionally, electrode 140 may be positioned at any other suitable location on device 100. In one embodiment, for example, all or part of electrode 140 may be disposed on tip 108. Thus, any suitable method for making device is contemplated.

In using any of the microfluidic devices described above or any other similar devices of the invention, one or more substances are first deposited in one or more reservoirs on a microfluidic device. Substances are then migrated along microchannel(s) of the device and are typically separated, using electric charge provided to the substances via an electrode or other source of electric charge. An electrode may also be used to help move the substances along the microchannels in some embodiments. Charge is also provided to the substances in order to provide electrospray ionization of the substances from an outlet of the device toward a mass spectrometer or other device. In many embodiments, the electrospray is provided in a desired spray pattern, such as a Taylor cone. In some embodiments, the spray is directed generally parallel to the longitudinal axis of the microchannel from which it comes. In other embodiments, the spray is directed in a non-parallel direction relative to the microchannel axis. The direction in which the spray is emitted may be determined, for example, by the shape of an ESI tip, by hydrophobic and/or hydrophilic surfaces adjacent the outlet (and/or protein binding characteristics), by the orientation of the outlet, and/or the like. In some cases it may be advantageous to have either a parallel or non-parallel spray.

Figures 4A, 4B, 4C:
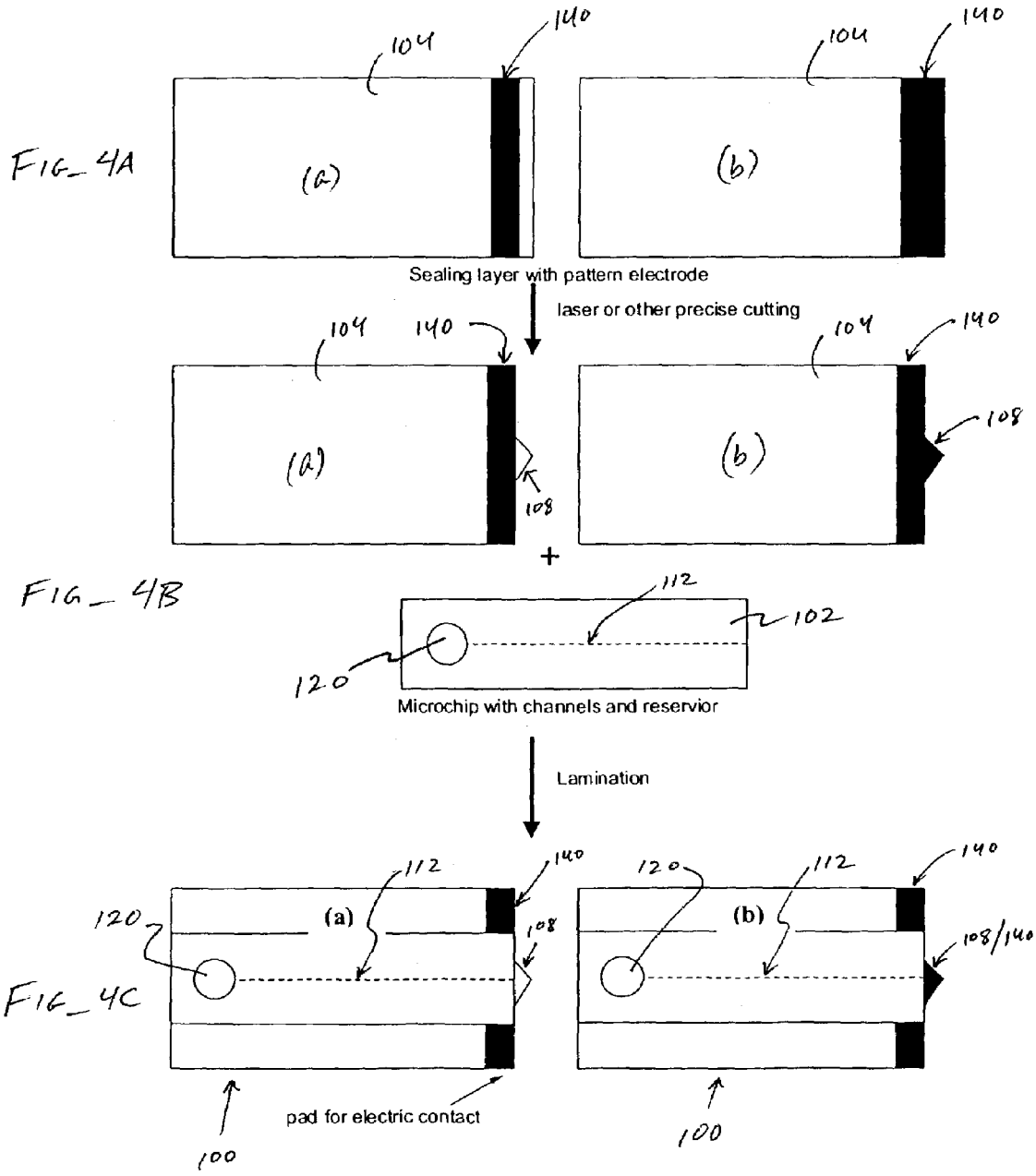
FIGS. 4A–4C are top views depicting a method for making a microfluidic device having an electrode according to an embodiment of the present invention.

FIGS. 4A–4C show two alternative embodiments of a method for making microfluidic device 100. These methods are similar to the one shown in FIGS. 3A–3C, but cutting or other fabricating of tip 108, as shown in FIG. 4B, is performed before coupling cover 104 with cubstrate 104. In these embodiments, electrode 140 is disposed close to tip 108, as shown on the left-sided figures (a), and/or on tip 108, as shown in the right-sided figures (b).

Figure 5A:
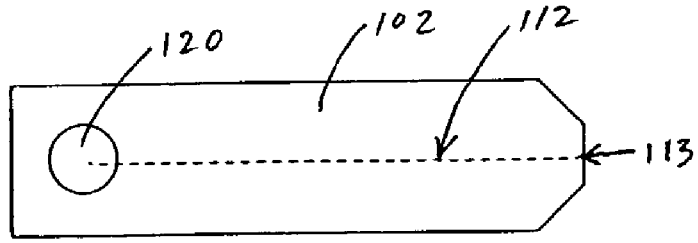
FIGS. 5A–5C are top views depicting a method for making a microfluidic device having an electrode according to an embodiment of the present invention.
Figure 5B:
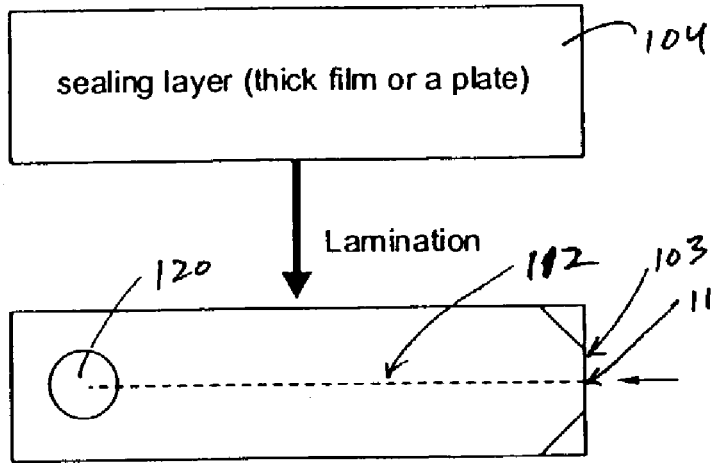
Figure 5C:
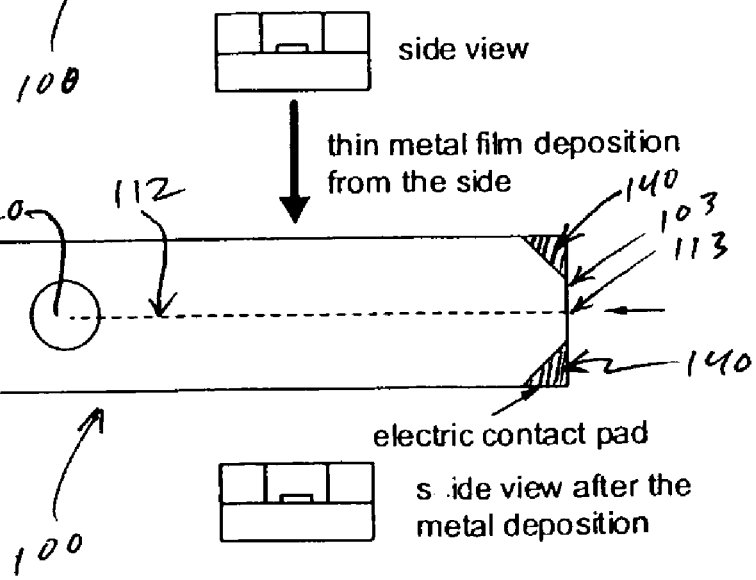

Referring now to FIGS. 5A–5C, another embodiment of a method of making microfluidic device 100. This embodiment does not include a tip, but positions outlet 113 at edge 103. In some embodiments, edge 103 may be recessed from an adjacent edge portion. A metal film, conductive ink or other electrode 140 is positioned near outlet 113. The method includes depositing a thin film of metal, conductive ink or the like onto the side of device 100 after lamination, as shown in the figures. In some embodiments, another cutting, followed by polishing could be performed before the deposition of the film, for example if the alignment between the top and bottom edges to be deposited with the metal electrodes is not as precise as desired. In some embodiments, networking of the channels may be molded onto the polymer materials to include the sample preparation and separation features.

Figure 6:
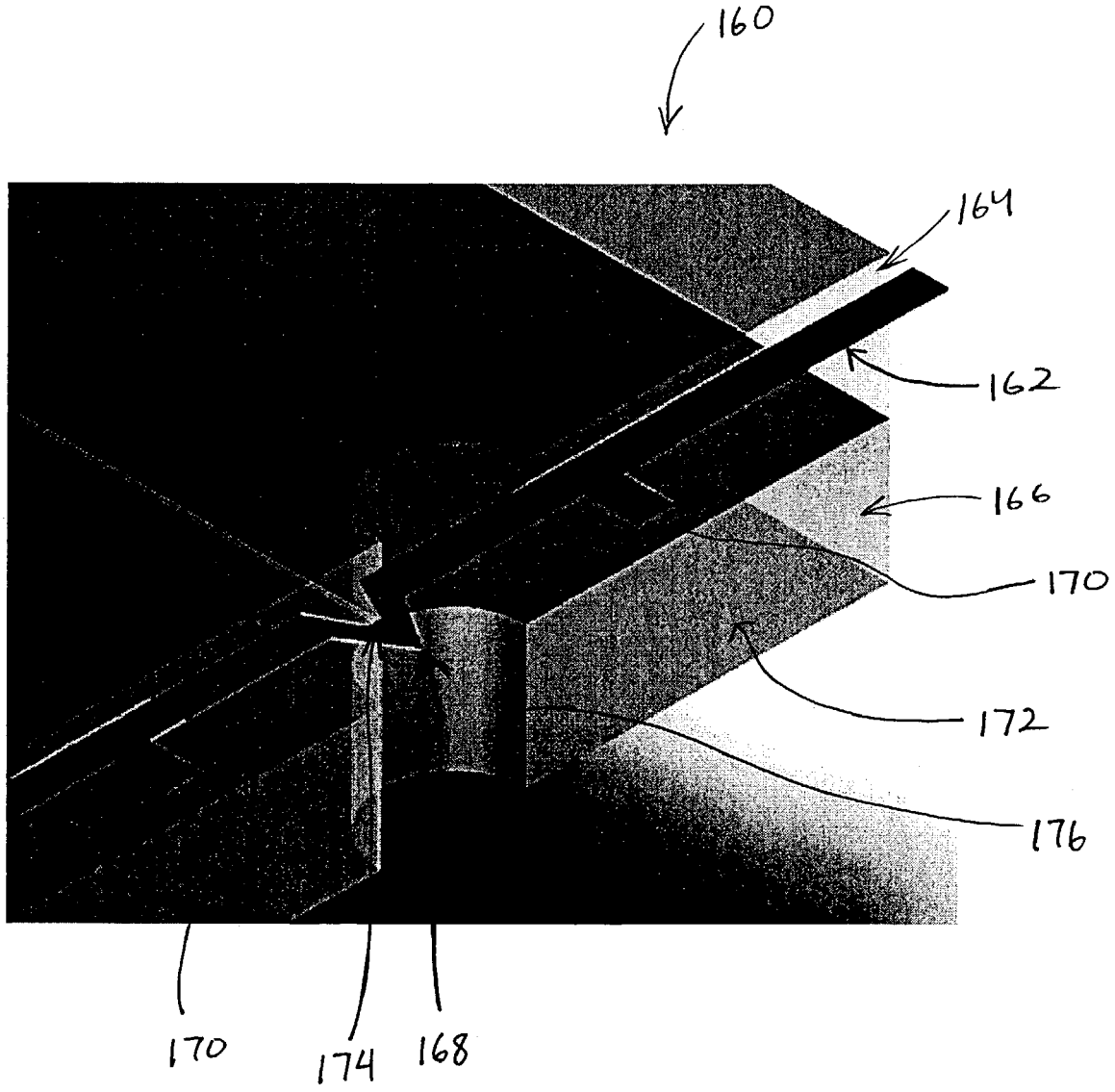
FIG. 6 is a perspective view of a portion of a microfluidic device manufactured according to principles of the present invention.

With reference now to FIG. 6, another embodiment of a microfluidic device 160 is shown in perspective view. This microfluidic device 160 is manufactured by bonding a thin polymer film 162 between an upper polymer plate 164 and a lower polymer plate 166, which are made to look "transparent" in FIG. 6 to show the design of thin polymer film 162. Thin polymer film 162 includes a tip 168, as well as one or more alignment features 170 for enabling placement of thin film 162 between the two plates 164, 166 so that tip 168 is aligned with an opening in a microchannel 174. In one embodiment, tip 168 is recessed from an edge 172 of microfluidic device 160. In some embodiments, tip 168 may be partially or completely coated with one or more metals to provide for electrical contact to the ESI tip in embodiments in which the electrospray is combined with other electrokinetically driven operations on microfluidic device 160, such as separation of substances. Advantageously, in some embodiments thin polymer film 162 is cut from a sheet rather than being patterned by lithography. Another advantageous feature of some embodiments is that a single strip or sheet of tips 168 may be aligned and bonded to a whole plate of chips simultaneously. Individual microfluidic devices 160 may then be separated by CNC milling, sawing, die cutting, laser cutting or the like, providing a convenient means for fabricating multiple microfluidic devices 160.

One embodiment of a method for making such microfluidic devices 160 involves first embossing microchannels 174 into one of plates 164, 166. Also alignment features 170 are embossed at or near edge 172 of device to allow for alignment of thin polymer film 162 between plates 164, 166. After embossing microchannel(s) 174, a circular opening 176 is drilled at a location (sometimes centered) at edge 172 of both plates 164, 166. In some embodiments, many devices 160 will be made from upper plate 164 and one lower plate 166, and all openings 176 may be drilled during the same procedure in some embodiments.

A next step, in some embodiments, is to laser-cut thin polymer film 162 (for example metal-coated polyimide or Mylar™) to a desired pattern, including alignment features 170. Thin film 162 may have any suitable thickness, but in some embodiments it will be between about 5 $\mu$ms and about 15 $\mu$ms. Before bonding, a strip of the laser-cut metal-coated polymer thin film 162 is placed between plates 164, 166 and is aligned using the etched alignment features 170. Holes 176 in plates 164, 166 are also aligned. In some embodiments, one strip of thin polymer film 162 may be used for an entire row of adjacent devices 160 on a larger precursor plate. Then, polymer plates 164, 166 are thermally bonded together, thereby bonding thin polymer film 162 between them. One goal of this step is to seal over thin polymer film 162 without unduly harming or flattening microchannel 174. Finally, individual microfluidic devices 160 may be separated by any suitable methods, such as by CNC milling, sawing, die cutting or laser cutting. These cuts generally pass through the centers of holes 176.

Many different embodiments of the above-described microfluidic device 160 and methods for making it are contemplated within the scope of the invention. For example, in some embodiments, one device 160 may be made at a time, while in other embodiments multiple devices 160 may be made from larger precursor materials and may then be cut into multiple devices 160. Also, any suitable material may be used for thin film 162, though one embodiment uses a metal-coated polymer. Some embodiments, for example, may use a Mylar™ film having a thickness of about 6 $\mu$ms and coated with aluminum, or a polyimide film coated with gold, or the like. Additionally, any of a number of different methods may be used to cut thin film 162, plates 164, 166 and the like, such as laser cutting with a UV laser, CO2 laser, YAG laser or the like, Excimer, die-cutting, machining, or any other suitable technique.

Several exemplary embodiments of microfluidic devices and methods for making and using those devices have been described. These descriptions have been provided for exemplary purposes only and should not be interpreted to limit the invention in any way. Many different variations, combinations, additional elements and the like may be used as part of the invention without departing from the scope of the invention as defined by the claims.

What is claimed is:

1. A method of making a microfluidic device for providing one or more substances to a mass spectrometer for analysis of the substances, the method comprising:

fabricating a substrate comprising:

at least one microchannel having a microfabricated surface; and an outlet in fluid communication with the microchannel and disposed along an edge surface of the substrate, the outlet recessed into the substrate relative to an adjacent portion of the edge surface; and applying a cover to the substrate.

2. A method for making a microfluidic device for providing one or more substances to a mass spectrometer for analysis of the substances, the method comprising:

fabricating a microfluidic body comprising:

first and second major surfaces with an edge surface therebetween;

at least one microchannel disposed between the first and second major surfaces, the microchannel having a microfabricated surface; and an outlet in fluid communication with the microchannel and disposed along the edge surface, the outlet recessed into the microfluidic body relative to an adjacent portion of the edge surface.

3. A method for providing at least one substance from a microfluidic device into a mass spectrometer, the method comprising:

moving the at least one substance through at least one microchannel in the microfluidic device; and causing the at least one substance to pass from the microchannel out of an outlet at a recessed edge of the microfluidic device.

4. A method as in claim 3, wherein providing the at least one substance comprises providing at least one substance in the form of ions.

5. A method as in claim 3, wherein the at least one substance is moved through at least one microchannel by applying an electrical potential to the substance.

6. A method as in claim 5, further including using the electrical potential to separate one or more substances.

7. A method as in claim 5, wherein applying the electrical potential to the substance does not generate a significant amount of bubbles in the substance.

8. A method as in claim 3, wherein the at least one substance is moved through at least one microchannel via pressure.

9. A method as in claim 3, wherein causing the substance to pass from the microchannel out of the outlet comprises directing the substance with at least one hydrophobic surface, and directing the substance with at least one surface of the microfluidic device selected from the group consisting of a hydrophilic surface and a surface that minimizes protein binding.

10. A method as in claim 3, wherein causing the substance to pass from the microchannel out of the outlet comprises directing the substance out of the outlet in a direction approximately parallel to a longitudinal axis of the at least one microchannel.

11. A method as in claim 3, wherein causing the substance to pass from the microchannel out of the outlet comprises directing the substance out of the outlet in a direction non-parallel to a longitudinal axis of the at least one microchannel.

12. A method as in claim 3, wherein causing the substance to pass from the microchannel out of the outlet comprises directing the substance out of the outlet in the form of a spray.

13. A method as in claim 12, wherein the spray has a desired spray geometry.

14. A method of making microfluidic devices for providing one or more substances to a mass spectrometer for analysis of the substances, the method comprising:

forming at least one microchannel on a first substrate;

forming a recessed edge on the first substrate and a second substrate;

providing a layer of film having at least one tip and at least one alignment feature;

aligning the layer of film between the first and second substrates; and bonding the layer of film between the first and second substrates.

15. A microfluidic device for providing one or more substances to a mass spectrometer for analysis of the substances, the microfluidic device comprising:

a microfluidic body having first and second major surfaces and at least one edge surface;

at least one microchannel disposed between the first and second major surfaces, the microchannel having a microfabricated surface; and at least one outlet in fluid communication with the microchannel and disposed along the edge surface, the outlet recessed into the microfluidic body relative to an adjacent portion of the edge surface.

16. A microfluidic device as in claim 15, wherein at least part of the microfabricated surface comprises a surface that minimizes protein binding.

17. A microfluidic device as in claim 16, wherein the surface that minimizes protein binding comprises a part of the microfabricated surface adjacent the outlet.

18. A microfluidic device as in claim 16, wherein the surface that minimizes protein binding is disposed along the entire length of the microfabricated surface.

19. A microfluidic device as in claim 16, wherein the surface that minimizes protein binding comprises at least one of a coated surface, a gel matrix, a polymer, a sol-gel monolith and a chemically modified surface.

20. A microfluidic device as in claim 19, wherein a coating on the coated surface comprises a material selected from the group consisting of cellulose polymer, polyacrylamide, polydimethylacrylamide, acrylarmide-based copolymer, polyvinyl alcohol, polyvinylpyrrolidone, plyethylene oxide, Pluronic™ polymers, poly-N-hydroxyethylacrylamide, Tween™, dextran, a sugar, hydroxyethyl methacrylate and indoleacetic acid.

21. A microfluidic device as in claim 19, wherein the chemically modified surface has been modified by at least one of gas plasma treatment, plasma polymerization, corona discharge treatment, UV/ozone treatment, and an oxidizing solution.

22. A microfluidic device as in claim 15, wherein at least part of the microfabricated surface comprises a hydrophilic surface.

23. A microfluidic device as in claim 22, wherein the hydrophilic surface comprises a part of the microfabricated surface adjacent the outlet.

24. A microfluidic device as in claim 22, wherein the hydrophilic surface is disposed along the entire length of the microfabricated surface.

25. A microfluidic device as in claim 22, wherein the hydrophilic surface comprises at least one of a coated surface, a gel matrix, a polymer, a sol-gel monolith and a chemically modified surface.

26. A microfluidic device as in claim 25, wherein a coating on the coated surface comprises a material selected from the group consisting of cellulose polymer, polyacrylamide, polydimethylacrylamide, acrylamide-based copolymer, polyvinyl alcohol, polyvinylpyrrolidone, plyethylene oxide, Pluronic™ polymers, poly-N-hydroxyethylacrylamide, Tween™, dextran, a sugar, hydroxyethyl methacrylate and indoleacetic acid.

27. A microfluidic device as in claim 25, wherein the chemically modified surface has been modified by at least one of gas plasma treatment, plasma polymerization, corona discharge treatment, UV/ozone treatment, and an oxidizing solution.

28. A microfluidic device as in claim 15, wherein at least one of the first major surface, the second major surface and the edge surface comprises, at least in part, a hydrophobic surface.

29. A microfluidic device as in claim 28, wherein the at least one hydrophobic surface is disposed adjacent the outlet.

30. A microfluidic device as in claim 15, wherein at least one of the first and second major surfaces comprises a material selected from the group consisting of glass, silicon, ceramic, polymer, copolymer, silicon dioxide, quartz, silica and a combination thereof.

31. A microfluidic device as in claim 30, wherein the polymer comprises a material selected from the group consisting of cyclic polyolefin, polycarbonate, polystyrene, PMMA, acrylate, polyimide, epoxy, polyethylene, polyether, polyethylene terephtalate, polyvinyl chloride, polydimethylsiloxane, polyurethane, polypropylene, phenol formaldehyde, polyacrylonitrile, Mylar™ and Teflon™.

32. A microfluidic device as in claim 15, further comprising at least one protrusion extending from at least one surface of the microchannel beyond the outlet, the protrusion recessed into the microfluidic body relative to the adjacent portion of the edge surface.

33. A microfluidic device as in claim 32, wherein the at least one protrusion comprises at least one surface that minimizes protein binding.

34. A microfluidic device as in claim 32, wherein the at least one protrusion comprises at least one hydrophilic surface.

35. A microfluidic device as in claim 32, wherein the at least one protrusion comprises at least one metallic surface.

36. A microfluidic device as in claim 32, wherein the at least one protrusion comprises at least one hydrophobic surface.

37. A microfluidic device as in claim 32, wherein the at least one protrusion comprises a pointed tip.

38. A microfluidic device as in claim 32, wherein the at least one protrusion comprises a semi-circular tip having a radius of less than 40 micrometers.

39. A microfluidic device as in claim 15, further comprising a source of pressure coupled with the device to move the substances through the microchannel.

40. A microfluidic device as in claim 15, further comprising a source of potential coupled with the device to move the substances through the microchannel by electrokinetic mobility.

41. A microfluidic device as in claim 15, further comprising a source of electrokinetic potential coupled with the device to move the substances through the microchannel.

42. A microfluidic device as in claim 15, further comprising an electrical potential source coupled with the device to move the substances through the microchannel.

43. A microfluidic device as in claim 42, wherein the electrical potential source comprises an electrical potential microchannel in fluid communication with the microchannel, the electrical potential microchannel containing at least one electrically conducting substance.

44. A microfluidic device as in claim 42, wherein the electrical potential source comprises an electrical potential microchannel which exits the microfluidic device immediately adjacent the microchannel, the electrical potential microchannel containing at least one electrically charged substance.

45. A microfluidic device as in claim 42, wherein the electrical potential source comprises at least one electrode on the microfluidics device.

46. A microfluidic device as in claim 45, wherein the at least one electrode provides potential for effecting at least one of electrophoretic separation of the substances and electrospray ionization.

47. A microfluidic device as in claim 45, wherein the at least one electrode provides potential for effecting at least one of electrokinetic movement of the substances in the microchannel and electrospray ionization.

48. A microfluidic device as in claim 45, wherein the electrode comprises at least one of copper, nickel, conductive ink, silver, silver/silver chloride, gold, platinum, palladium, iridium, aluminum, titanium, tantalum, niobium, carbon, doped silicon, indium tin oxide, other conductive oxides, polyanaline, sexithiophene, polypyrrole, polythiophene, polyethylene dioxythiophene, carbon black, carbon fibers, conductive fibers, and other conductive polymers and conjugated polymers.

49. A microfluidic device as in claim 45, wherein the at least one electrode generates the electrical potential without producing a significant quantity of bubbles in the one or more substances.

50. A microfluidic device as in claim 15, wherein the outlet has a cross-sectional dimension of between about 0.1 micron and about 500 microns.

51. A microfluidic device as in claim 15, wherein the outlet has a cross-sectional dimension of between about 50 microns and about 150 microns.

52. A microfluidic device as in claim 15, wherein the outlet has a cross-sectional dimension of between about 1 micron and about 5 microns.

53. A microfluidic device as in claim 15, wherein the outlet has a cross-sectional dimension of between about 5 microns and about 50 microns.

54. A microfluidic device for providing one or more substances to a mass spectrometer for analysis of the substances, the microfluidic device comprising:

a microfluidic body having first and second major surfaces and at least one edge surface;

at least one microchannel disposed between the first and second major surfaces, the microchannel having a microfabricated surface;

at least one outlet in fluid communication with the microchannel and disposed along the edge surface, the outlet recessed into the microfluidic body relative to an adjacent portion of the edge surface; and at least one protruding tip separated from the outlet and disposed in a path of fluid flow from the outlet, the protruding tip recessed into the microfluidic body relative to the adjacent portion of the edge surface.

55. A microfluidic device as in claim 54, wherein at least one of the microfabricated surface and the protruding tip comprises a surface that minimizes protein binding.

56. A microfluidic device as in claim 55, wherein the surface that minimizes protein binding is disposed adjacent the outlet.

57. A microfluidic device as in claim 55, wherein the surface that minimizes protein binding comprises at least one of a coated surface, a gel matrix, a polymer, a sol-gel monolith and a chemically modified surface.

58. A microfluidic device as in claim 57, wherein a coating on the coated surface comprises a material selected from the group consisting of cellulose polymer, polyacrylamide, polydimethylacrylamide, acrylarmide-based copolymer, polyvinyl alcohol, polyvinylpyrrolidone, plyethylene oxide, Pluronic™ polymers, poly-N-hydroxyethylacrylamide, Tween™, dextran, a sugar, hydroxyethyl methacrylate and indoleacetic acid.

59. A microfluidic device as in claim 57, wherein the chemically modified surface has been modified by at least one of gas plasma treatment, plasma polymerization, corona discharge treatment, UV/ozone treatment, and an oxidizing solution.

60. A microfluidic device as in claim 54, wherein at least one of the microfabricated surface and the protruding tip comprises a hydrophilic surface.

61. A microfluidic device as in claim 60, wherein the hydrophilic surface is disposed adjacent the outlet.

62. A microfluidic device as in claim 60, wherein the hydrophilic surface comprises at least one of a coated surface, a gel matrix, a polymer, a sol-gel monolith and a chemically modified surface.

63. A microfluidic device as in claim 62, wherein a coating on the coated surface comprises a material selected from the group consisting of cellulose polymer, polyacrylamide, polydimethylacrylamide, acrylamide-based copolymer, polyvinyl alcohol, polyvinylpyrrolidone, plyethylene oxide, Pluronic™ polymers, poly-N-hydroxyethylacrylamide, Tween™, dextran, a sugar, hydroxyethyl methacrylate and indoleacetic acid.

64. A microfluidic device as in claim 25, wherein the chemically modified surface has been modified by at least one of gas plasma treatment, plasma polymerization, corona discharge treatment, UV/ozone treatment, and an oxidizing solution.

65. A microfluidic device as in claim 54, wherein at least one of first major surface, the second major surface and the edge surface comprises, at least in part, a hydrophobic surface.

66. A microfluidic device as in claim 65, wherein the at least one hydrophobic surface is disposed adjacent the outlet.

67. A microfluidic device as in claim 54, wherein at least one of the first and second major surfaces comprises a material selected from the group consisting of glass, silicon, ceramic, polymer, copolymer, silicon dioxide, quartz, silica and a combination thereof.

68. A microfluidic device as in claim 67, wherein the polymer comprises a material selected from the group consisting of cyclic polyolefin, polycarbonate, polystyrene, PMMA, acrylate, polyimide, epoxy, polyethylene, polyether, polyethylene terephtalate, polyvinyl chloride, polydimethylsiloxane, polyurethane, polypropylene, phenol formaldehyde, polyacrylonitrile, Mylar™ and Teflon™.

69. A microfluidic device as in claim 54, further comprising a source of pressure coupled with the device to move the substances through the microchannel.

70. A microfluidic device as in claim 54, further comprising a source of potential coupled with the device to move the substance through the microchannel by electrophoretic mobility.

71. A microfluidic device as in claim 54, further comprising a source of potential coupled with the device to move the substance through the microchannel by electrokinetic mobility.

72. A microfluidic device as in claim 54, further comprising an electrical potential source coupled with the device to move the substances through the microchannel.

73. A microfluidic device as in claim 72, wherein the electrical potential source comprises an electrical potential microchannel in fluid communication with the microchannel, the electrical potential microchannel containing at least one electrically charged substance.

74. A microfluidic device as in claim 72, wherein the electrical potential source comprises an electrical potential microchannel which exits the microfluidic device immediately adjacent the microchannel, the electrical potential microchannel containing at least one electrically charged substance.

75. A microfluidic device as in claim 72, wherein the electrical potential source comprises at least one electrode on the microfluidic device.

76. A microfluidic device as in claim 75, wherein the at least one electrode provides potential for effecting at least one of electrophoretic separation of the substances and electrospray ionization.

77. A microfluidic device as in claim 75, wherein the at least one electrode provides potential for effecting at least one of electrokinetic movement of the substances in the microchannel and electrospray ionization.

78. A microfluidic device as in claim 75, wherein the at least one electrode comprises at least one of copper, nickel, conductive ink, silver, silver/silver chloride, gold, platinum, palladium, iridium, aluminum, titanium, tantalum, niobium, carbon, doped silicon, indium tin oxide, other conductive oxides, polyanaline, sexithiophene, polypyrrole, polythiophene, polyethylene dioxythiophene, carbon black, carbon fibers, conductive fibers, and other conductive polymers and conjugated polymers.

79. A microfluidic device as in claim 75, wherein the at least one electrode generates the electrical potential without producing a significant quantity of bubbles in the substances.

80. A microfluidic device as in claim 54, wherein the protruding tip is selected from the group consisting of a pyramidal tip, a conical tip, a helical tip, a tubular tip, a triangular tip, a rectangular tip and a round tip.

81. A microfluidic device as in claim 54, wherein the outlet has a cross-sectional dimension of between about 0.1 micron and about 500 microns.

82. A microfluidic device as in claim 54, wherein the outlet has a cross-sectional dimension of between about 50 microns and about 150 microns.

83. A microfluidic device as in claim 54, wherein the outlet has a cross-sectional dimension of between about 1 micron and about 5 microns.

84. A microfluidic device as in claim 54, wherein the outlet has a cross-sectional dimension of between about 5 microns and about 50 microns.

85. A microfluidic device for providing one or more substances to a mass spectrometer for analysis of the substances, the microfluidic device comprising:

a microfluidic body having first and second major surfaces and at least one edge surface;

at least one microchannel disposed between the first and second major surfaces, the microchannel having a microfabricated surface; and a layer of film disposed between the first and second major surfaces to form at least one tip the tip in fluid communication with the microchannel and recessed into the microfluidic body relative to an adjacent portion of the edge surface.

* * * * *